US008701232B1

(12) United States Patent
Droege et al.

(10) Patent No.: US 8,701,232 B1
(45) Date of Patent: Apr. 22, 2014

(54) METHOD OF FORMING AN ARTICLE OF FOOTWEAR INCORPORATING A TRIMMED KNITTED UPPER

(71) Applicant: Nike, Inc., Beaverton, OR (US)

(72) Inventors: John Droege, Portland, OR (US); Daniel A. Podhajny, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/018,969

(22) Filed: Sep. 5, 2013

(51) Int. Cl.
*A43D 29/00* (2006.01)

(52) U.S. Cl.
USPC ..... 12/142 R; 12/146 C

(58) Field of Classification Search
USPC ..... 12/142 R, 146 C, 146 CK; 36/45, 97
See application file for complete search history.

(56) References Cited

U.S. PATENT DOCUMENTS

| | | | | |
|---|---|---|---|---|
| 601,192 | A | 3/1898 | Woodside | |
| 1,215,198 | A | 2/1917 | Rothstein | |
| 1,597,934 | A | 8/1926 | Stimpson | |
| 1,888,172 | A | 11/1932 | Joha | |
| 1,902,780 | A | 3/1933 | Holden et al. | |
| 1,910,251 | A | 5/1933 | Joha | |
| 2,001,293 | A | 5/1935 | Wilson | |
| 2,047,724 | A | 7/1936 | Zuckerman | |
| 2,147,197 | A * | 2/1939 | Glidden | 36/9 R |
| 2,314,098 | A | 3/1943 | McDonald | |
| 2,330,199 | A | 9/1943 | Basch | |
| 2,343,390 | A | 3/1944 | Ushakoff | |
| 2,400,692 | A | 5/1946 | Herbert | |
| 2,440,393 | A | 4/1948 | Clark | |
| 2,465,911 | A * | 3/1949 | Morgan | 36/72 R |
| 2,467,237 | A * | 4/1949 | Sherman et al. | 12/142 G |
| 2,569,764 | A | 10/1951 | Jonas | |
| 2,586,045 | A | 2/1952 | Hoza | |
| 2,608,078 | A | 8/1952 | Anderson | |

(Continued)

FOREIGN PATENT DOCUMENTS

| | | |
|---|---|---|
| DE | 870963 | 3/1953 |
| DE | 1084173 | 6/1960 |

(Continued)

OTHER PUBLICATIONS

Declaration of Dr. Edward C. Frederick from the US Patent and Trademark Office Inter Partes Review of US Patent No. 7,347,011 (178 pp).

(Continued)

*Primary Examiner* — Marie Bays
(74) *Attorney, Agent, or Firm* — Plumsea Law Group, LLC

(57) ABSTRACT

A method of forming an article of footwear includes knitting a knitted workpiece formed of unitary knit construction. The knitted workpiece is configured to at least partially form an upper of the article of footwear. The knitted workpiece has a body and a trim region. The trim region defines at least a portion of an outer edge of the knitted workpiece. A first dimension of the knitted workpiece is at least partly defined by the outer edge. The method also includes heating the knitted workpiece. Also, the method includes trimming the knitted workpiece within the trim region after heating the knitted workpiece to remove a piece from the knitted workpiece and to reduce the first dimension to a second dimension. Also, the method includes forming the upper from the trimmed knitted workpiece.

19 Claims, 19 Drawing Sheets

(56) References Cited

U.S. PATENT DOCUMENTS

| | | | | |
|---|---|---|---|---|
| 2,641,004 | A | 6/1953 | Whiting et al. | |
| 2,675,631 | A | 4/1954 | Doughty | |
| 2,994,322 | A | 8/1961 | Cullen et al. | |
| 3,329,983 | A * | 7/1967 | Clamp | 12/146 C |
| 3,583,081 | A | 6/1971 | Hayashi | |
| 3,694,940 | A | 10/1972 | Stohr | |
| 3,698,027 | A * | 10/1972 | Schwab et al. | 12/142 R |
| 3,704,474 | A | 12/1972 | Winkler | |
| 3,766,566 | A | 10/1973 | Tadakoro | |
| 3,778,856 | A | 12/1973 | Christie et al. | |
| 3,952,427 | A | 4/1976 | Von den Benken et al. | |
| 3,972,086 | A | 8/1976 | Belli et al. | |
| 4,027,402 | A | 6/1977 | Liu et al. | |
| 4,031,586 | A | 6/1977 | Von den Benken et al. | |
| 4,211,806 | A | 7/1980 | Civardi et al. | |
| 4,232,458 | A | 11/1980 | Bartels | |
| 4,255,949 | A | 3/1981 | Thorneburg | |
| 4,258,480 | A | 3/1981 | Famolare, Jr. | |
| 4,317,292 | A | 3/1982 | Melton | |
| 4,373,361 | A | 2/1983 | Thorneburg | |
| 4,447,967 | A | 5/1984 | Zaino | |
| 4,465,448 | A | 8/1984 | Aldridge | |
| 4,562,834 | A * | 1/1986 | Bates et al. | 602/3 |
| 4,607,439 | A | 8/1986 | Harada et al. | |
| 4,737,396 | A | 4/1988 | Kamat | |
| 4,750,339 | A | 6/1988 | Simpson et al. | |
| 4,756,098 | A | 7/1988 | Boggia | |
| 4,785,558 | A | 11/1988 | Shiomura | |
| 4,813,158 | A | 3/1989 | Brown | |
| 4,967,491 | A * | 11/1990 | Plotkin | 36/7.1 R |
| 5,031,423 | A | 7/1991 | Ikenaga | |
| 5,095,720 | A | 3/1992 | Tibbals, Jr. | |
| 5,117,567 | A | 6/1992 | Berger | |
| 5,152,025 | A | 10/1992 | Himas | |
| 5,192,601 | A | 3/1993 | Neisler | |
| 5,345,638 | A | 9/1994 | Nishida | |
| 5,353,524 | A | 10/1994 | Brier | |
| 5,371,957 | A | 12/1994 | Gaudio | |
| 5,461,884 | A | 10/1995 | McCartney et al. | |
| 5,511,323 | A | 4/1996 | Dahlgren | |
| 5,572,860 | A | 11/1996 | Mitsumoto et al. | |
| 5,575,090 | A | 11/1996 | Condini | |
| 5,623,840 | A | 4/1997 | Roell | |
| 5,729,918 | A | 3/1998 | Smets | |
| 5,735,145 | A | 4/1998 | Pernick | |
| 5,746,013 | A | 5/1998 | Fay, Sr. | |
| 5,765,296 | A | 6/1998 | Ludemann et al. | |
| 5,884,419 | A | 3/1999 | Davidowitz et al. | |
| 5,996,189 | A | 12/1999 | Wang | |
| 6,029,376 | A | 2/2000 | Cass | |
| 6,032,387 | A | 3/2000 | Johnson | |
| 6,052,921 | A | 4/2000 | Oreck | |
| 6,088,936 | A | 7/2000 | Bahl | |
| 6,151,802 | A | 11/2000 | Reynolds | |
| 6,170,175 | B1 | 1/2001 | Funk | |
| 6,308,438 | B1 | 10/2001 | Throneburg et al. | |
| 6,333,105 | B1 | 12/2001 | Tanaka et al. | |
| 6,401,364 | B1 | 6/2002 | Burt | |
| 6,558,784 | B1 | 5/2003 | Norton et al. | |
| 6,588,237 | B2 | 7/2003 | Cole et al. | |
| 6,754,983 | B2 | 6/2004 | Hatfield et al. | |
| 6,910,288 | B2 | 6/2005 | Dua | |
| 6,922,917 | B2 | 8/2005 | Kerns et al. | |
| 6,931,762 | B1 | 8/2005 | Dua | |
| D517,297 | S | 3/2006 | Jones et al. | |
| 7,051,460 | B2 | 5/2006 | Orei et al. | |
| 7,056,402 | B2 | 6/2006 | Koerwien et al. | |
| 7,347,011 | B2 | 3/2008 | Dua et al. | |
| 7,441,348 | B1 | 10/2008 | Dawson | |
| 7,543,397 | B2 | 6/2009 | Kilgore et al. | |
| 7,568,298 | B2 | 8/2009 | Kerns | |
| 7,682,219 | B2 | 3/2010 | Falla | |
| 8,490,299 | B2 | 7/2013 | Dua et al. | |
| 2002/0078599 | A1 | 6/2002 | Delgorgue et al. | |
| 2002/0148258 | A1 | 10/2002 | Cole et al. | |
| 2002/0178610 | A1 * | 12/2002 | Cheng | 36/3 A |
| 2003/0089000 | A1 * | 5/2003 | Tseng | 36/45 |
| 2003/0126762 | A1 | 7/2003 | Tseng | |
| 2003/0191427 | A1 | 10/2003 | Jay et al. | |
| 2004/0118018 | A1 | 6/2004 | Dua | |
| 2004/0181972 | A1 | 9/2004 | Csorba | |
| 2005/0115284 | A1 | 6/2005 | Dua | |
| 2005/0193592 | A1 * | 9/2005 | Dua et al. | 36/45 |
| 2005/0273988 | A1 | 12/2005 | Christy | |
| 2005/0284000 | A1 | 12/2005 | Kerns | |
| 2006/0059715 | A1 | 3/2006 | Aveni | |
| 2006/0162187 | A1 | 7/2006 | Byrnes et al. | |
| 2007/0022627 | A1 | 2/2007 | Sokolowski et al. | |
| 2007/0180730 | A1 | 8/2007 | Greene et al. | |
| 2007/0294920 | A1 | 12/2007 | Baychar | |
| 2008/0017294 | A1 | 1/2008 | Bailey et al. | |
| 2008/0022554 | A1 * | 1/2008 | Meschter et al. | 36/45 |
| 2008/0078102 | A1 | 4/2008 | Kilgore et al. | |
| 2008/0110048 | A1 | 5/2008 | Dua et al. | |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2011/0030244 | A1 | 2/2011 | Motawi et al. | |
| 2011/0078921 | A1 | 4/2011 | Greene et al. | |
| 2012/0233882 | A1 | 9/2012 | Huffa et al. | |
| 2012/0255201 | A1 | 10/2012 | Little | |

FOREIGN PATENT DOCUMENTS

| | | |
|---|---|---|
| DE | 19738433 | 4/1998 |
| DE | 19728848 | 1/1999 |
| EP | 0279950 | 8/1988 |
| EP | 0448714 | 10/1991 |
| EP | 0728860 | 8/1996 |
| EP | 0758693 | 2/1997 |
| EP | 0898002 | 2/1999 |
| EP | 1233091 | 8/2002 |
| EP | 1437057 | 7/2004 |
| EP | 1563752 | 8/2005 |
| EP | 1602762 | 12/2005 |
| EP | 1972706 | 9/2008 |
| FR | 2171172 | 9/1973 |
| GB | 538865 | 8/1941 |
| GB | 2018837 | 10/1979 |
| GB | 1603487 | 11/1981 |
| JP | H06113905 | 4/1994 |
| JP | H08109553 | 4/1996 |
| JP | H11302943 | 11/1999 |
| NL | 7304678 | 10/1974 |
| WO | 9003744 | 4/1990 |
| WO | 0032861 | 6/2000 |
| WO | 0231247 | 4/2002 |

OTHER PUBLICATIONS

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Search Report and Written Opinion in connection with PCT/US2009/056795 mailed on Apr. 20, 2010.

International Search Report and Written Opinion in connection with PCT/US2012/028576 mailed on Oct. 1, 2012.

International Search Report and Written Opinion in connection with PCT/US2012/028559 mailed on Oct. 19, 2012.

International Search Report and Written Opinion in connection with PCT/US2012/028534 mailed on Oct. 17, 2012.

International Preliminary Report on Patentability in connection with PCT/US2012/028534 mailed Sep. 17, 2013.

International Preliminary Report on Patentability in connection with PCT/US2012/028576 mailed Sep. 17, 2013.

U.S. Appl. No. 13/944,638, filed Jul. 17, 2013.

U.S. Appl. No. 13/944,675, filed Jul. 17, 2013.

* cited by examiner

METHOD OF FORMING AN ARTICLE OF FOOTWEAR INCORPORATING A TRIMMED KNITTED UPPER

BACKGROUND

Conventional articles of footwear generally include two primary elements: an upper and a sole structure. The upper is secured to the sole structure and forms a void within the footwear for comfortably and securely receiving a foot. The sole structure is secured to a lower surface of the upper so as to be positioned between the upper and the ground.

In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal a lower surface of the foot to enhance footwear comfort.

The upper can extend over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally utilized in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. Specifically, the upper may be formed of leather, synthetic leather, or a rubber material. The upper may be formed from numerous material elements that each imparts different properties to the upper.

SUMMARY

A method of forming an article of footwear is disclosed. The method includes knitting a knitted workpiece formed of unitary knit construction. The knitted workpiece is configured to at least partially form an upper of the article of footwear. The knitted workpiece has a body and a trim region. The trim region defines at least a portion of an outer edge of the knitted workpiece. A first dimension of the knitted workpiece is at least partly defined by the outer edge. The method also includes heating the knitted workpiece. Also, the method includes trimming the knitted workpiece within the trim region after heating the knitted workpiece to remove a piece from the knitted workpiece and to reduce the first dimension to a second dimension. Also, the method includes forming the upper from the trimmed knitted workpiece.

Additionally, a method of forming an article of footwear that is configured to fit one of a first foot size and a second foot size is disclosed. The first foot size is larger than the second foot size. The method includes selecting whether to form the article of footwear to fit the first foot size or the second foot size. Also, the method includes providing a knitted workpiece formed of unitary knit construction, wherein the knitted workpiece includes a body and a trim region. Still further, the method includes trimming the knitted workpiece within the trim region to form a first trimmed piece when it has been selected to form the article of footwear to fit the first foot size, and alternatively trimming the knitted workpiece within the trim region to form a second trimmed piece when it has been selected to form the article of footwear to fit the second foot size. The first trimmed piece is configured to form a first upper that fits the first foot size, and the second trimmed piece is configured to form a second upper that fits the second foot size.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

Figure 1:
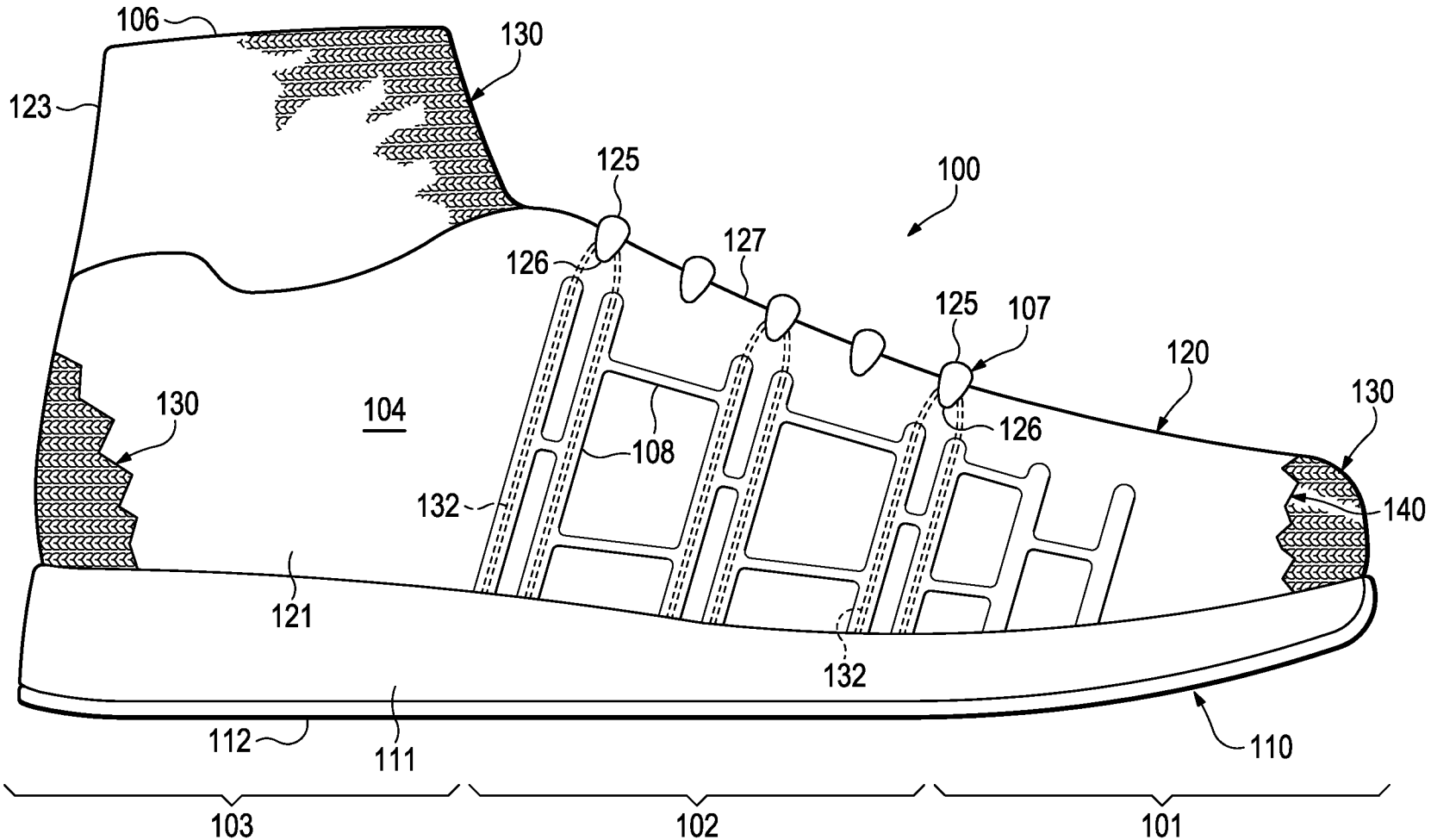
FIG. 1 is a lateral side view of an article of footwear according to exemplary embodiments of the present disclosure.

The following discussion and accompanying figures disclose an article of footwear having an upper that includes a knitted component and a method for manufacturing such an upper. In some embodiments, the upper can be formed from a knitted workpiece that is trimmed down to a predetermined size to fit a particular anatomical foot size. This can increase manufacturing efficiency and provide additional advantages as will be explained in greater detail below.

The article of footwear is disclosed as having a general configuration suitable for walking or running. Concepts associated with the footwear, including the upper, may also be applied to a variety of other athletic footwear types, including soccer shoes, baseball shoes, basketball shoes, cross-training shoes, cycling shoes, football shoes, sprinting shoes, tennis shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

Footwear Configurations

An article of footwear 100 is depicted in FIGS. 1-4 as including a sole structure 110 and an upper 120. Whereas sole structure 110 is located under and supports a foot of a wearer, upper 120 provides a comfortable and secure covering for the foot. As such, the foot may be located within a void in upper 120 to effectively secure the foot within footwear 100 or otherwise unite the foot and footwear 100. Moreover, sole structure 110 is secured to a lower area of upper 120 and extends between the foot and the ground to attenuate ground reaction forces (i.e., cushion the foot), provide traction, enhance stability, and influence the motions of the foot, for example.

For reference purposes, footwear 100 may be divided into three general regions: a forefoot region 101, a midfoot region 102, and a heel region 103. Forefoot region 101 generally encompasses portions of footwear 100 corresponding with forward portions of the foot, including the toes and joints connecting the metatarsals with the phalanges. Midfoot region 102 generally encompasses portions of footwear 100 corresponding with middle portions of the foot, including an arch area. Heel region 103 generally encompasses portions of footwear 100 corresponding with rear portions of the foot, including the heel and calcaneus bone. Footwear 100 also includes a lateral side 104 and a medial side 105, which extend through forefoot region 101, midfoot region 102, and heel region 103, and which correspond with opposite sides of footwear 100. More particularly, lateral side 104 corresponds with an outside area of the foot (i.e. the surface that faces away from the other foot), and medial side 105 corresponds with an inside area of the foot (i.e., the surface that faces toward the other foot). Forefoot region 101, midfoot region 102, heel region 103, lateral side 104, and medial side 105 are not intended to demarcate precise areas of footwear 100. Rather, forefoot region 101, midfoot region 102, heel region 103, lateral side 104, and medial side 105 are intended to represent general areas of footwear 100 to aid in the following discussion. In addition to footwear 100, forefoot region 101, midfoot region 102, heel region 103, lateral side 104, and medial side 105 may also be applied to sole structure 110, upper 120, and individual elements thereof.

Figure 4:
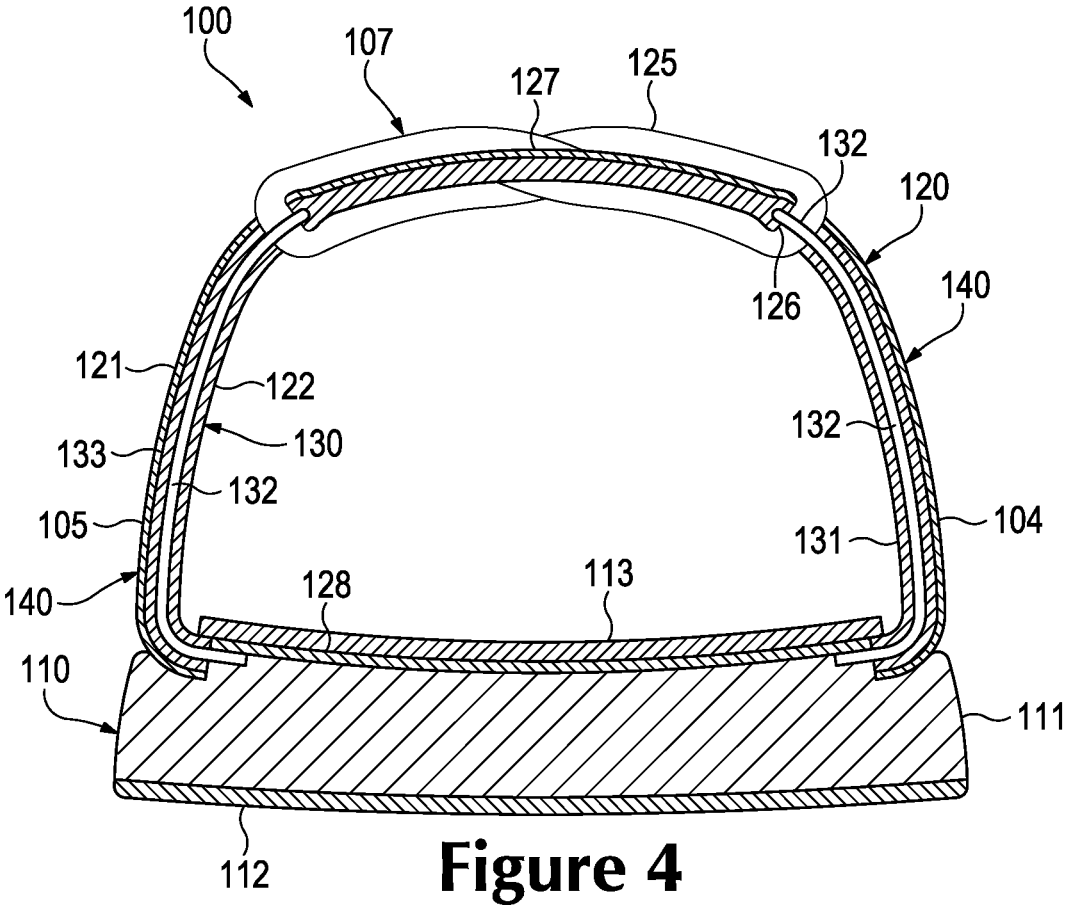
FIG. 4 is a section view of the article of footwear taken along the line 4-4 of FIG. 3.

Sole structure 110 can include a midsole 111, an outsole 112, and a sockliner 113, each of which is shown in the section view of FIG. 4. Midsole 111 can be secured to a lower surface of upper 120 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 111 may incorporate plates, moderators, fluid-filled chambers, lasting elements, or motion control members that further attenuate forces, enhance stability, or influence the motions of the foot, or midsole 111 may be primarily formed from a fluid-filled chamber. Outsole 112 can be secured to a lower surface of midsole 111 and may be formed from a wear-resistant rubber material that is textured to impart traction. Sockliner 113 can be located within the void in upper 120 and positioned to extend under a lower surface of the foot to enhance the comfort of footwear 100. Although this configuration for sole structure 110 provides an example of a sole structure that may be used in connection with upper 120, a variety of other conventional or nonconventional configurations for sole structure 110 may also be utilized. For example, outsole 112 can additionally include cleats or spikes that are configured to penetrate into the ground in some embodiments. Accordingly, the features of sole structure 110 or any sole structure utilized with upper 120 may vary from the illustrated embodiments without departing from the scope of the present disclosure.

Upper 120 includes an exterior surface 121 and an opposite interior surface 122. Whereas exterior surface 121 faces outward and away from footwear 100, interior surface 122 faces inward and can define a majority or a relatively large portion of the void within footwear 100 for receiving the foot. The void can be shaped to accommodate the wearer's foot. When the foot is located within the void, therefore, upper 120 can extend along a lateral side of the foot, along a medial side of the foot, over the foot, around the heel, and under the foot. Moreover, interior surface 122 may lie against the foot or a sock covering the foot.

Figure 2:
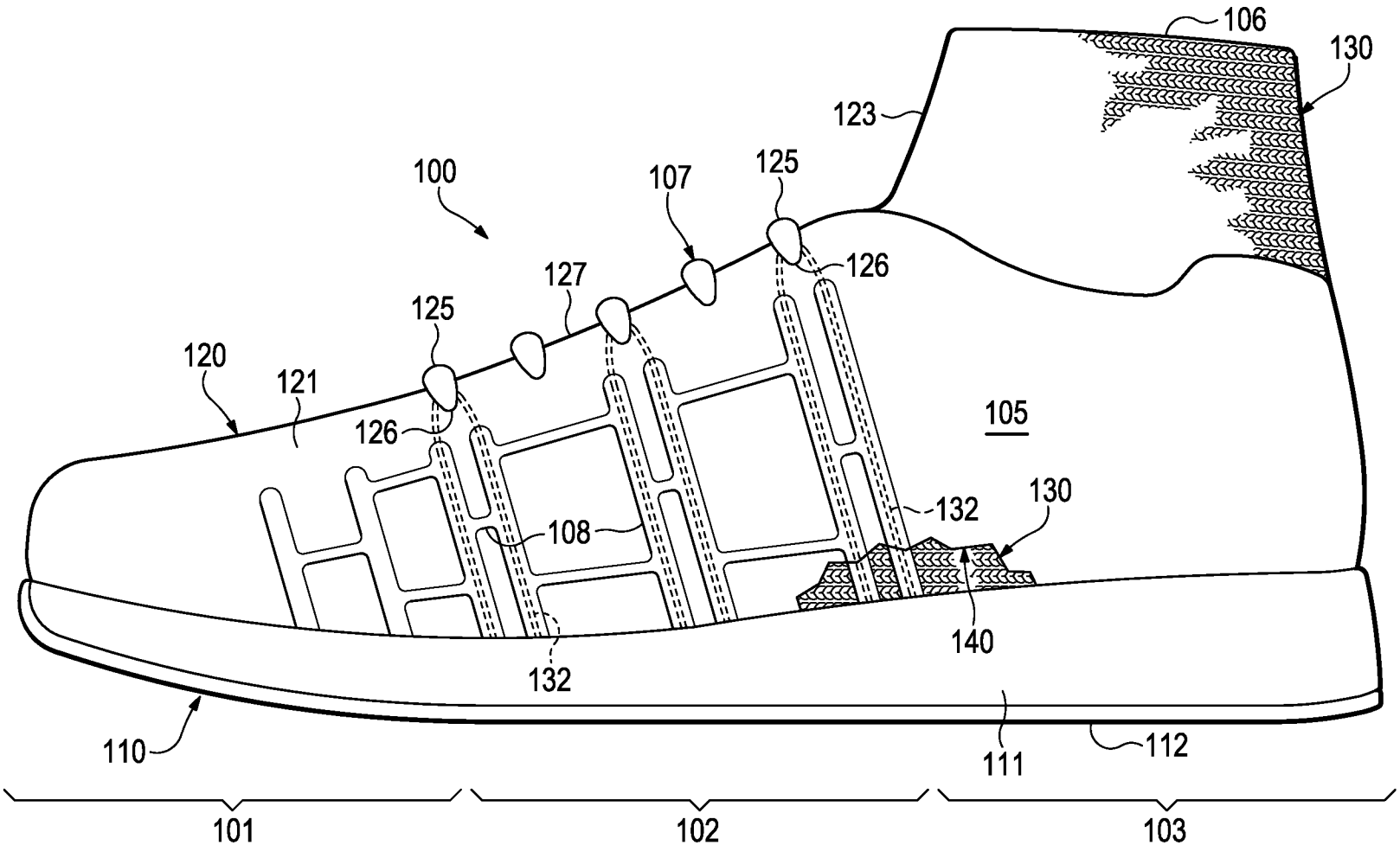
FIG. 2 is a medial side view of the article of footwear of FIG. 1.

As shown in FIGS. 1 and 2, upper 120 can also include a collar 123 that is primarily located in heel region 103 and forms an opening 106 that provides the foot with access to the void within upper 120. More particularly, the foot may be inserted into upper 120 through opening 106 formed by collar 123, and the foot may be withdrawn from upper 120 through opening 106 formed by collar 123. As shown in FIGS. 1 and 2, collar 123 can be of a so-called "high top" or "high rise" collar for extending up and over the wearer's ankle. In additional embodiments, collar 123 can be of a so-called "low rise" collar that merely extends around the wearer's ankle.

Figure 3:
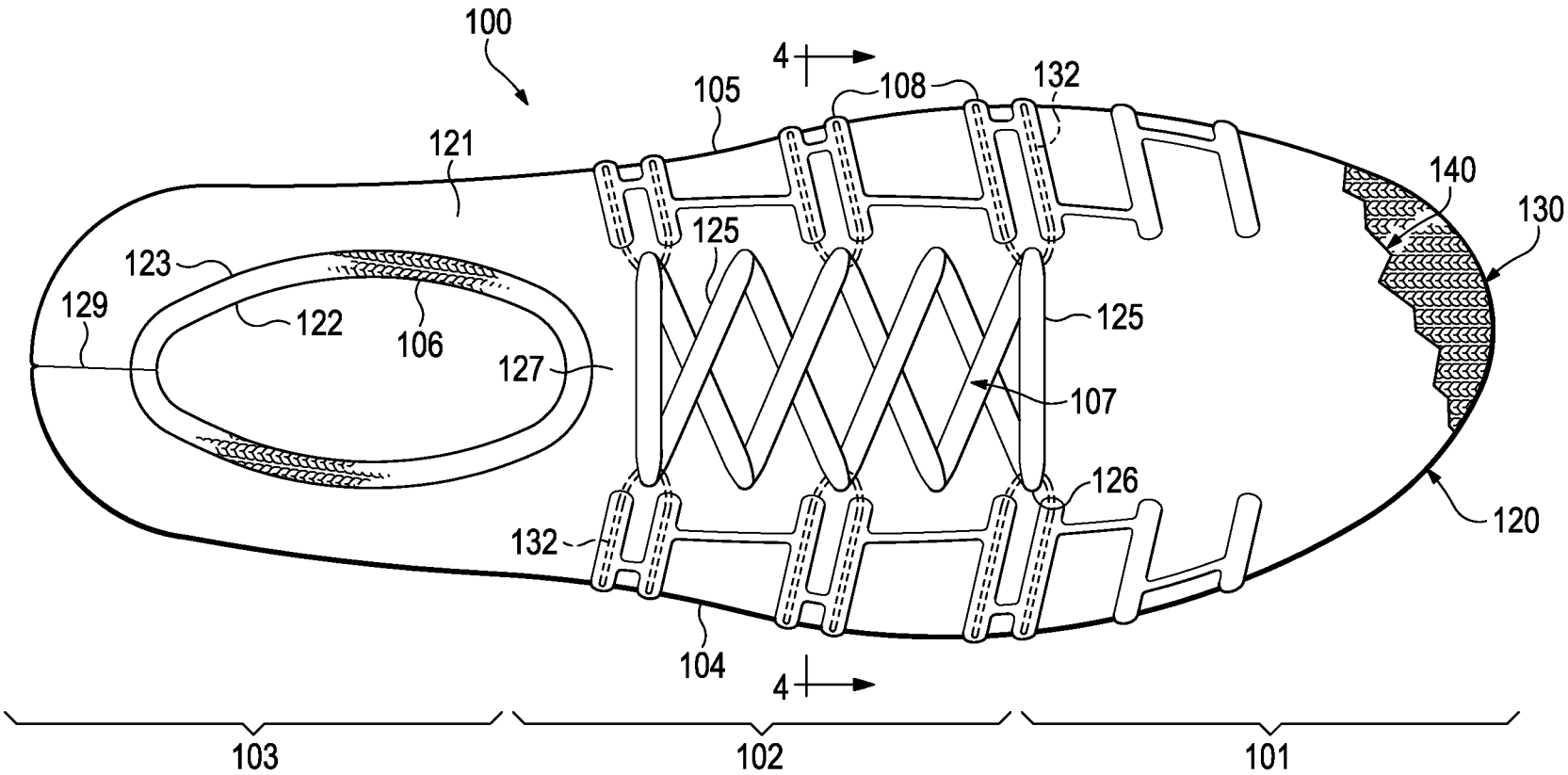
FIG. 3 is a top view of the article of footwear of FIG. 1.

A throat area 127 can be included forward of collar 123 and can extend longitudinally toward forefoot region 101 and between lateral side 104 and medial side 105. As shown in FIG. 3, throat area 127 can be integrally attached to forefoot region 101, lateral side 104, and medial side 105. In other embodiments, throat area 127 can include a tongue that is detached from lateral side 104 and medial side 105. As such, the tongue can be moveably received within an opening within throat area 127 between lateral side 104 and medial side 105.

In some embodiments, a closure element 107 can also be included that is used to selectively secure upper 120 to the wearer's foot. Closure element 107 can be of any suitable type, such as a lace 125 as shown in the illustrated embodiments. In other embodiments, closure element 107 may also include one or more buckles, straps, loop-and-pile tape, or other suitable implements for securing upper 120 to a wearer's foot.

As shown in the illustrated embodiments, lace 125 can engage various lace-receiving elements 126. Although lace-receiving elements 126 are depicted in FIGS. 1-4 as apertures in upper 120, and with lace 125 passing through the apertures, lace-receiving elements 126 may be loops, eyelets, hooks, D-rings, or other suitable lace-receiving element.

As shown in FIG. 3, lace 125 can follow a zigzagging path between respective lace-receiving elements 126. Moreover, lace 125 can repeatedly-pass across and between opposite sides of throat area 127. When using footwear 100, lace 125 permits the wearer to selectively modify dimensions of upper 120 to accommodate the proportions of the foot. More particularly, lace 125 may be manipulated in a conventional manner to permit the wearer to (a) tighten upper 120 around the foot and (b) loosen upper 120 to facilitate insertion and withdrawal through opening 106 formed by collar 123.

Figure 5:
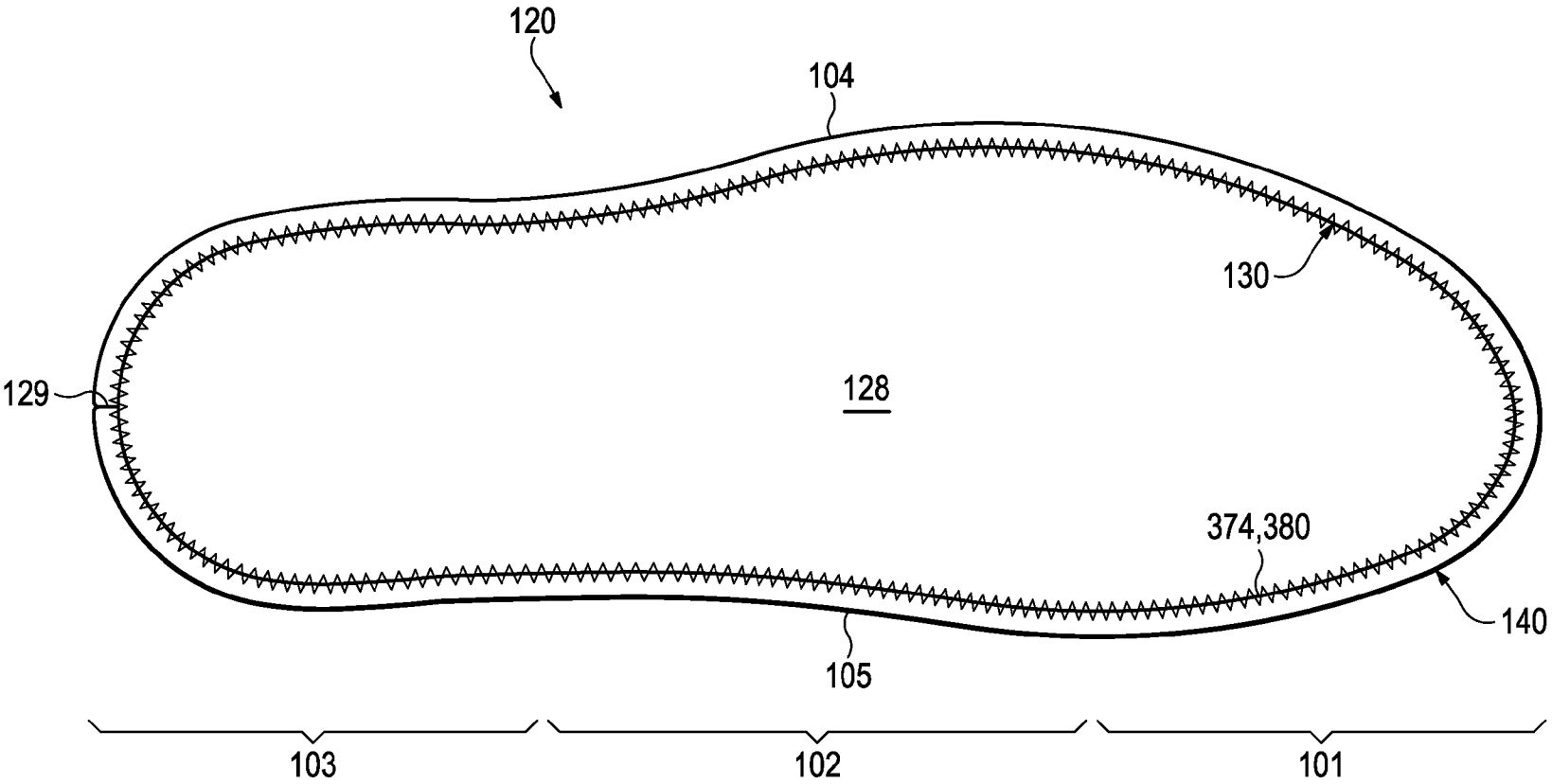
FIG. 5 is a bottom view of an upper of the article of footwear of FIG. 1 with a strobel.

Also, upper 120 may extend under the wearer's foot. For example, upper 120 can include a strobel 128 or strobel sock, which is configured to extend under the wearer's foot as shown in FIGS. 4 and 5. In this configuration, sockliner 113 extends over strobel 128 as shown in FIG. 4 and forms a surface upon which the wearer's foot rests.

In some embodiments, upper 120 can include one or more tensile strands 132. Tensile strands 132 can be yarns, cables, wires, ropes, or other strands that can extend across upper 120. Tensile strands 132 can be tensioned to support upper 120 and/or to distribute forces across upper 120. For example, in the illustrated embodiment, upper 120 includes one or more tensile strands 132 that extend upward along upper 120 from sole structure 110, that loop around lace-receiving elements 126, and that extend back down toward sole structure 110. Accordingly, tensile strands 132 can reinforce respective ones of the lace-receiving elements 126. Also, tension in lace 125 can transfer to tensile strands 132, and tensile strands 132 can distribute loads to the upper 120 such that upper 120 can fit more securely to the wearer's foot.

In the illustrated embodiments, lateral side 104 and medial side 105 of upper 120 each include respective tensile strands 132. Also, as shown, tensile strands 132 can extend about only some of the lace-receiving elements 126. It will be appreciated, however, that upper 120 can include any number of tensile strands 132 and that tensile strands 132 can be routed along any suitable area of upper 120 without departing from the scope of the present disclosure. Moreover, tensile strands 132 suitable for use with upper 120 may include the tensile strands and/or tensile elements disclosed in one or more of commonly-owned U.S. patent application Ser. No. 12/338,726 to Dua et al., entitled "Article of Footwear Having An Upper Incorporating A Knitted Component", filed on Dec. 18, 2008 and published as U.S. Patent Application Publication Number 2010/0154256 on Jun. 24, 2010, and U.S. patent application Ser. No. 13/048,514 to Huffa et al., entitled "Article Of Footwear Incorporating A Knitted Component", filed on Mar. 15, 2011 and published as U.S. Patent Application Publication Number 2012/0233882 on Sep. 20, 2012, both of which applications are hereby incorporated by reference in their entirety.

Many conventional footwear uppers are formed from multiple material elements (e.g., polymer foam, polymer sheets, leather, synthetic leather) that are joined together through stitching or bonding, for example. However, in various embodiments discussed herein, upper 120 can be at least partially formed from a knitted component 130. Knitted component 130 can have any suitable shape and size. Knitted component 130 can be formed of a unitary knit construction as a one-piece element as will be discussed in detail below.

Knitted component 130 can be configured to at least partially extend through forefoot region 101, midfoot region 102, and/or heel region 103. Knitted component 130 can also extend along lateral side 104, medial side 105, over forefoot region 101, and/or around heel region 103. In addition, knitted component 130 can at least partially define exterior surface 121 and/or interior surface 122 of upper 120.

As will be discussed in detail below, and as shown in FIG. 3, edges of knitted component 130 can be joined at a seam 129 to define at least some of the 3-dimensional curvature of the upper 120. As shown in FIG. 3, seam 129 is located generally in the heel region 103 of upper 120; however, seam 129 can be disposed in any suitable location on upper 120. Knitted component 130 can also include a plurality of seams in some embodiments.

As will be discussed, knitted component 130 can provide upper 120 with weight savings as compared with other conventional uppers. Additionally, in some embodiments, knitted component 130 can provide desirable texture or other characteristics to upper 120. Still further, knitted component 130 can provide advantages in the manufacture of footwear 100. Other advantages provided by knitted component 130 will be explored in detail below.

In some embodiments, knitted component 130 can be formed to include one or more protruding areas 108. Protruding areas 108 can be defined on exterior surface 121 of upper 120 as illustrated in FIG. 3. Protruding areas 108 can have any suitable shape and location. For example, protruding areas 108 can be elongate and can extend upward from sole structure 110 on both lateral side 104 and medial side 105. Moreover, portions of protruding areas 108 can extend longitudinally, generally between heel region 103 and forefoot region 101. Protruding areas 108 can be formed according to commonly-owned U.S. patent application Ser. No. 13/944,638 to Baines et al., entitled "Article of Footwear Incorporating a Knitted Component", filed on Jul. 17, 2013, the disclosure of which application is hereby incorporated by reference in its entirety. It will be appreciated that protruding areas 108 can increase surface area of upper 120 and can increase friction when footwear 100 is used, for example, to kick or trap a ball. Protruding areas 108 can also increase the wearer's ability to "feel" the ball when kicking or trapping a ball.

Additionally, in some embodiments, upper 120 may optionally include a skin layer 140 that is attached to knitted component 130. A suitable configuration for skin layer 140 can be any of the embodiments of a skin layer described in commonly-owned U.S. patent application Ser. No. 13/944,675 to Baudouin et al., entitled "Article of Footwear Incorporating a Knitted Component", filed on Jul. 17, 2013, the disclosure of which application is hereby incorporated by reference in its entirety.

Skin layer 140 can lay adjacent to knitted component 130 and can be secured an exterior of knitted component 130, thereby forming a majority or a relatively large portion of exterior surface 121 of upper 120. Various materials may be utilized to form skin layer 140, including a polymer sheet, elements of leather or synthetic leather, a woven or non-woven textile, or a metal foil. As with knitted component 130, skin layer 140 can extend through each of forefoot region 101, midfoot region 102, and heel region 103, along both lateral side 104 and medial side 105, over forefoot region 101, and around heel region 103. Skin layer 140 is depicted as being absent from interior surface 122 of upper 120. In further configurations of footwear 100, skin layer 140 may be absent from other areas of upper 120 or may extend over interior surface 122. Additionally, it will be appreciated that upper 120 may not include skin layer in some embodiments and may instead be primarily constructed from knitted component 130 alone.

Embodiments of Workpiece for Forming Multiple Uppers

In some embodiments, a knitted workpiece may be formed that is configured to be trimmed to predetermined alternative dimensions, each associated with a differently-sized of articles of footwear. As such, manufacturing efficiency for the article of footwear can be increased. Also, assembly of the article of footwear can also be facilitated. Other advantages will also be discussed in detail below.

Figure 6:
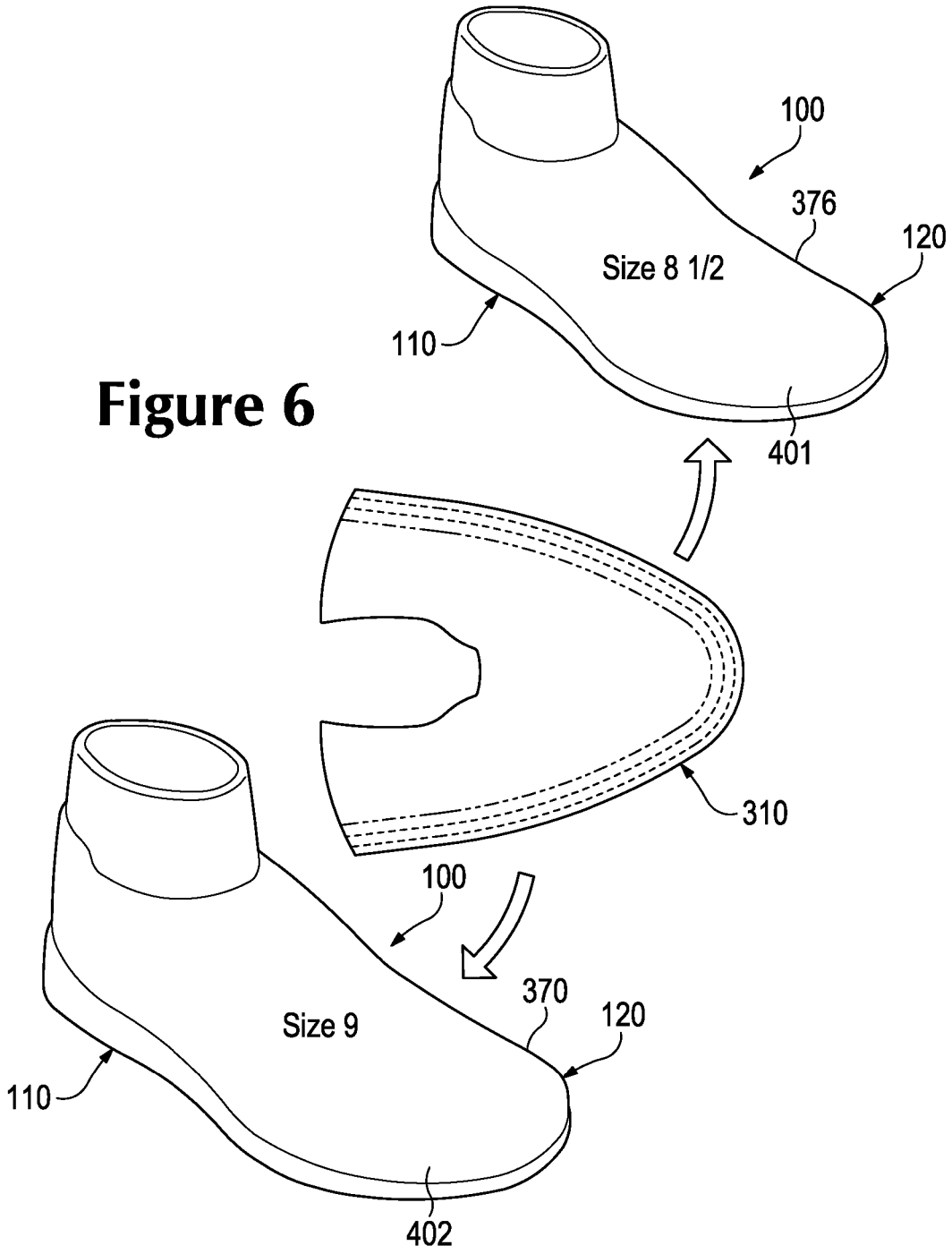
FIG. 6 is a schematic view of a workpiece including a knitted component that can be formed into one of a plurality of different-sized uppers for the article of footwear of FIG. 1.

Referring now to FIG. 6, a knitted workpiece 310 suitable for forming into one of a plurality of different-sized uppers for the article of footwear 100 is illustrated schematically. As will be explained, workpiece 310 can be constructed into either a first upper of a first foot size 401 or a second upper of a second foot size 402. In FIG. 6, the first upper 401 is illustrated as a size 8.5, and the second upper is illustrated as a size 9. The size 8.5 footwear can fit an anatomical foot size that is smaller than that of the size 9 footwear. It will be appreciated that the shoe sizes shown in FIG. 6 are merely exemplary, and other shoe sizes can be made from workpiece 310. Also, workpiece 310 could be used for making an upper of any shoe size. Additionally, it will be appreciated that workpiece 310 could be used for making three or more uppers wherein each upper fits to a different anatomical foot size.

Workpiece 310 can be trimmed by hand or automatically to reduce the size of workpiece 310. As such, workpiece 310 can be trimmed according to the desired size of the upper 120 for the article of footwear. For example, workpiece 310 can be trimmed to a first size to form the first upper 401 of FIG. 6, and knitted component 130 can alternatively be trimmed to a different second size to form the second upper 402 of FIG. 6.

Figure 7A:
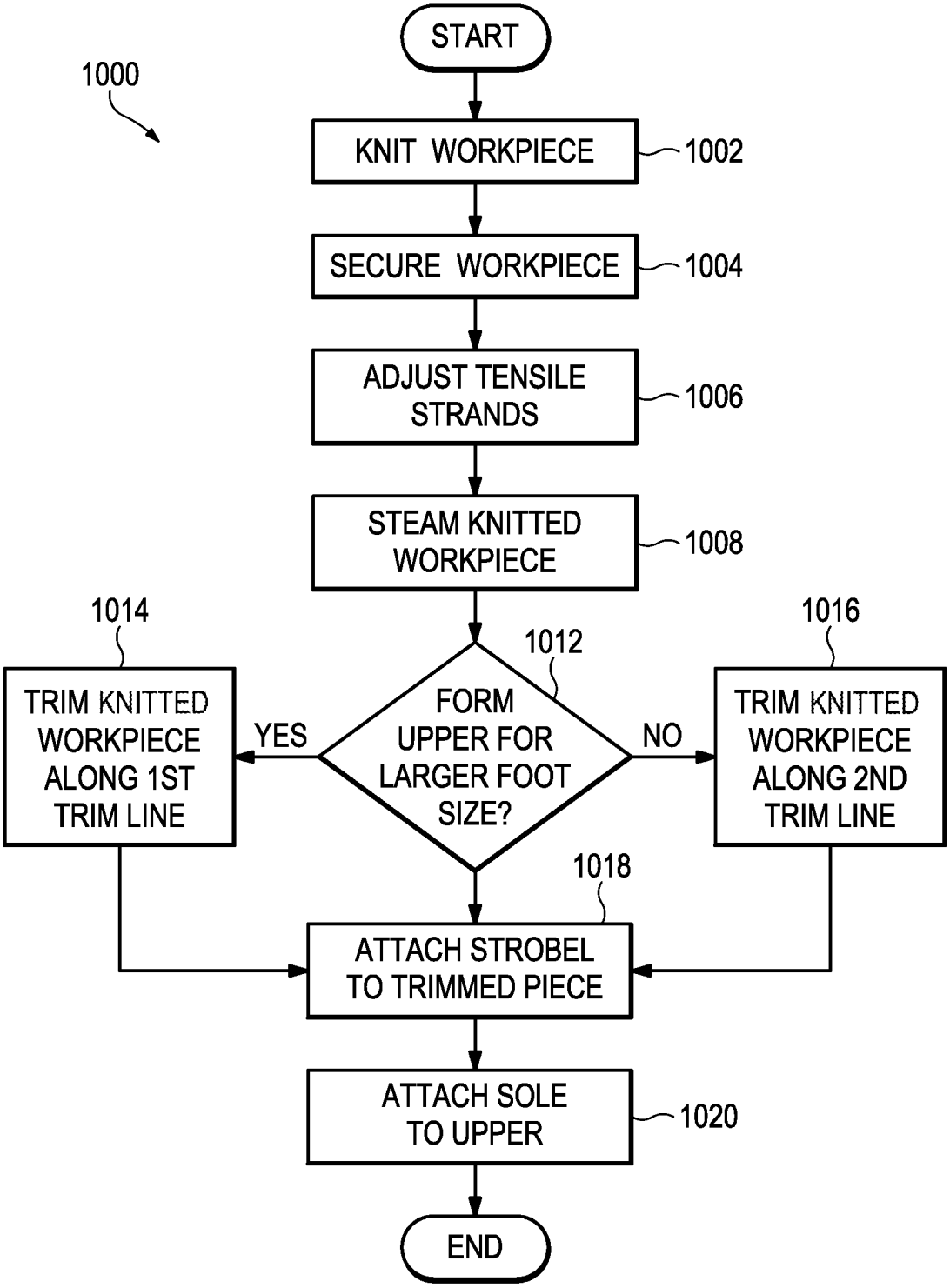
FIG. 7A is a flowchart of a method of manufacturing the article of footwear of FIG. 1 according to exemplary embodiments.

Various methods, machines, and tools can be used for forming, trimming, and otherwise adjusting workpiece 310 and for forming article of footwear 100 from workpiece 310. For example, FIG. 7A illustrates an exemplary method 1000 in flowchart form. It will be appreciated that the order of steps within method 1000 can vary from the order shown in FIG. 7A. Certain steps or aspects of some steps shown in FIG. 7A can be skipped or eliminated as well. Moreover, two or more steps within method 1000 can be carried out sequentially or simultaneously. Furthermore, the steps within method 1000 can be carried out manually using any suitable tools. Also, the steps within method 1000 can be carried out automatically using any suitable tool, machine, or implement.

Figure 8:
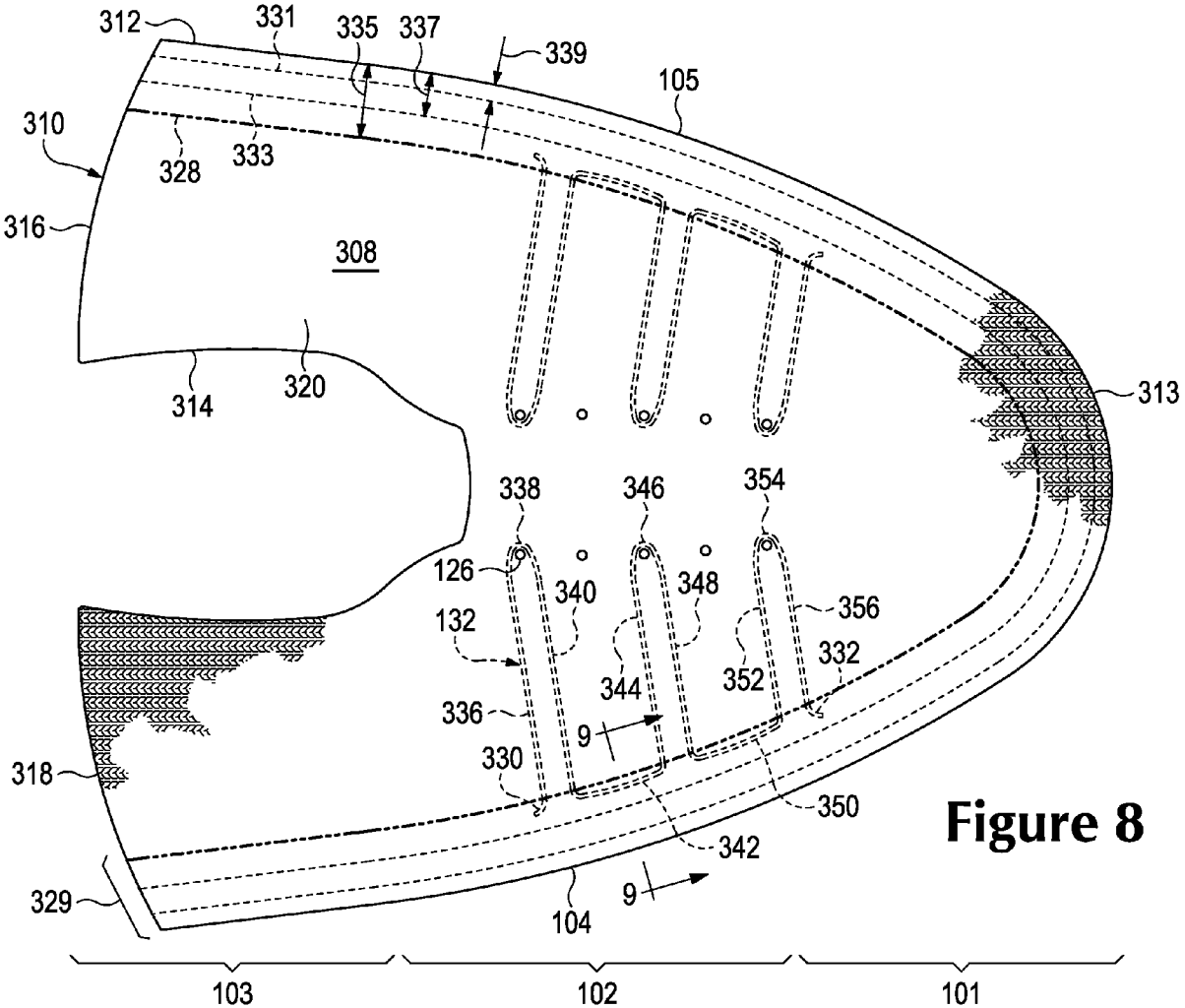
FIG. 8 is a plan view of a workpiece for the article of footwear of FIG. 1 according to exemplary embodiments of the present disclosure.

Generally, in the embodiments represented in FIG. 7A, method 1000 can begin in step 1002, wherein a knitting process is used to form a knitted workpiece 310, such as the knitted workpiece 310 shown in FIG. 8. Then, knitted workpiece 310 can be further processed and adjusted, for example, in step 1004, step 1006, and step 1008. These steps are also illustrated according to exemplary embodiments in FIGS. 12-15. Then, in decision step 1012 of FIG. 7A, it can be decided whether to form an upper suitable for the first foot size 401 shown in FIG. 6 or to form an upper suitable for the second foot size 402 shown in FIG. 6. Method 1000 continues in either step 1016, in which the upper for the smaller first foot size 401 is formed, or in step 1014, in which the upper for the larger second foot size 402 is formed from workpiece 310. Then, the strobel 128 and sole structure 110 are attached in steps 1018 and 1020, respectively, to finish construction of footwear 100. Each of these steps of method 1000 will be discussed in detail below.

Figure 7B:
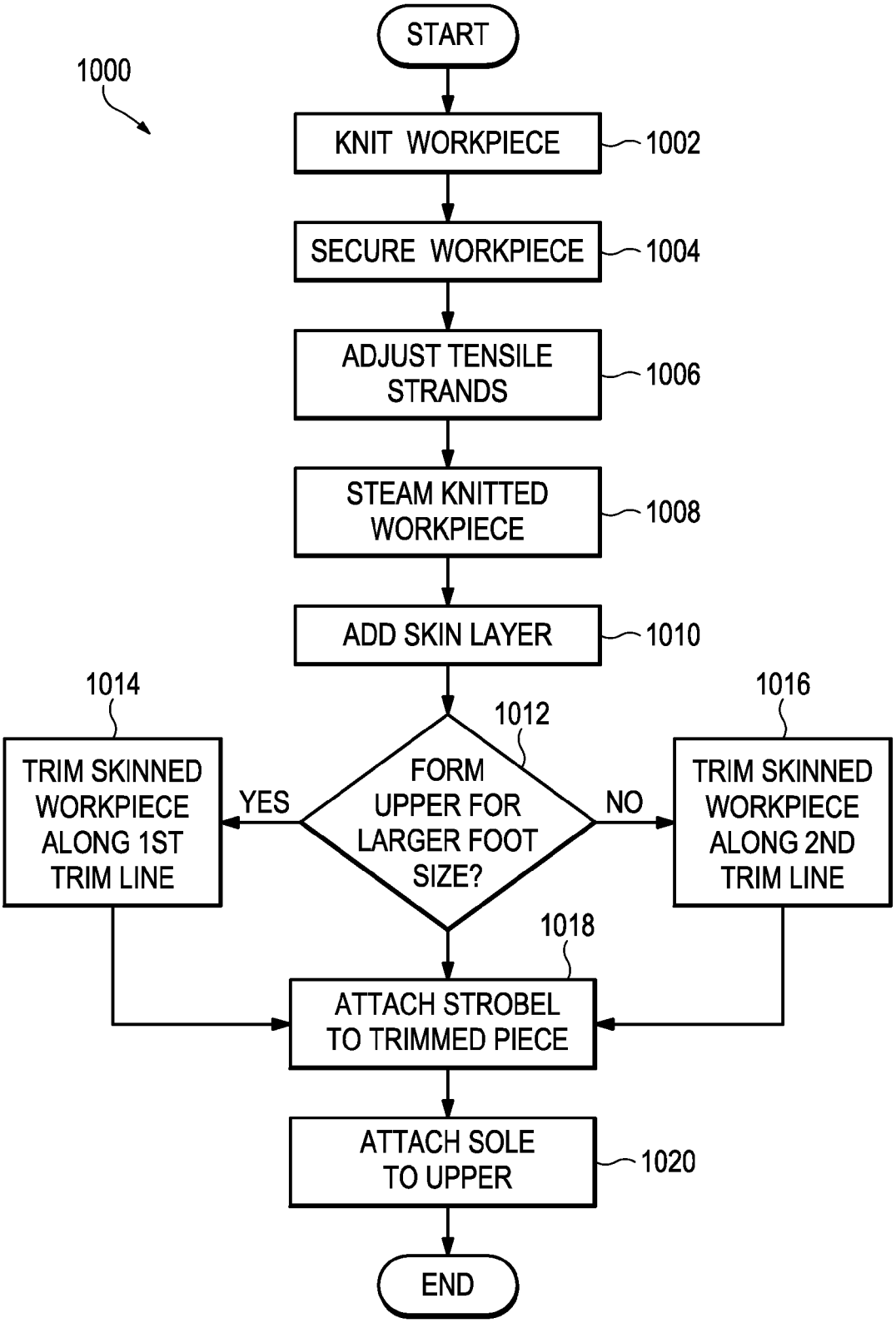
FIG. 7B is a flowchart of the method of manufacturing the article of footwear of FIG. 1 according to additional exemplary embodiments.

In additional embodiments shown in FIG. 7B, the method 1000 includes additional steps. For example, the method 1000 can be substantially similar to the embodiments represented in FIG. 7A, except that method 1000 of FIG. 7B can include step 1010. Specifically, skin layer 140 can be added in step 1010, which is also illustrated according to exemplary embodiments in FIG. 16, and which will be discussed in greater detail below.

Method of Manufacturing Footwear With Trimmable Upper

Embodiments of method 1000 illustrated in FIG. 7A will now be discussed in greater detail. Method 1000 can begin in step 1002. In step 1002, knitted workpiece 310 can be formed. For example, knitted workpiece 310 can be formed according to the exemplary embodiments of FIG. 8.

Knitted workpiece 310 can be formed of a unitary knit construction. As used herein, the term "unitary knit construction" means that the respective component is formed as a one-piece element through a knitting process. That is, the knitting process substantially forms the various features and structures of unitary knit construction without the need for significant additional manufacturing steps or processes. A unitary knit construction may be used to form a knitted component having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided. Examples of various configurations of knitted components and methods for forming knitted workpiece 310 with unitary knit construction are disclosed in U.S. Pat. No. 6,931,762 to Dua; U.S. Pat. No. 7,347,011 to Dua, et al.; U.S. Patent Application Publication 2008/0110048 to Dua, et al.; U.S. Patent Application Publication 2010/0154256 to Dua; and U.S. Patent Application Publication 20120233882 to Huffa, et al., each of which are entirely incorporated herein by reference.

Knitted workpiece 310 can be formed from at least one yarn that is manipulated (e.g., with a knitting machine) to form a plurality of intermeshed loops that define a knit element 313 having a variety of courses and wales. Thus, adjacent areas of knit element 313 can share at least one common course or at least one common wale. That is, knit element 313 can have the structure of a knit textile. It will be appreciated that knit element 313 can be formed via weft knitting operations, warp knitting operations, flat knitting operations, circular knitting operations, or other suitable methods.

Knit element 313 may incorporate various types and combinations of stitches and yarns. With regard to stitches, the yarn forming knit element 313 may have one type of stitch in one area of knit element 313 and another type of stitch in another area of knit element 313. Depending upon the types and combinations of stitches utilized, areas of knit element 313 may have a plain knit structure, a mesh knit structure, or a rib knit structure, for example. The different types of stitches may affect the physical properties of knit element 313, including aesthetics, stretch, thickness, air permeability, and abrasion-resistance of knit element 313. That is, the different types of stitches may impart different properties to different areas of knit element 313. With regard to yarns, knit element 313 may have one type of yarn in one area of knit element 313 and another type of yarn in another area of knit element 313. Depending upon various design criteria, knit element 313 may incorporate yarns with different deniers, materials (e.g., cotton, elastane, polyester, rayon, wool, and nylon), and degrees of twist, for example. The different types of yarns may affect the physical properties of knit element 313, including aesthetics, stretch, thickness, air permeability, and abrasion-resistance of knit element 313. That is, the different types of yarns may impart different properties to different areas of knit element 313. By combining various types and combinations of stitches and yarns, each area of knit element 313 may have specific properties that enhance the comfort, durability, and performance of footwear 100. In some configurations, multiple yarns with different colors may be utilized to form knit element 313. When yarns with different colors are twisted together and then knitted, knit element 313 may have a heathered appearance with multiple colors randomly distributed throughout.

Also, one or more of the yarns within knit element 313 may be partially formed from a thermoplastic polymer material, which softens or melts when heated and returns to a solid state when cooled. More particularly, the thermoplastic polymer material transitions from a solid state to a softened or liquid state when subjected to sufficient heat, and then the thermoplastic polymer material transitions from the softened or liquid state to the solid state when sufficiently cooled. As such, the thermoplastic polymer materials within the yarns can be used to join two objects or elements together as will be discussed in greater detail below. Knit element 313 can incorporate these so-called "fusible" yarns according to co-owned U.S. Pat. No. 6,910,288, which issued on Jun. 28, 2005, and which is incorporated by reference in its entirety.

As stated, method step 1002 of FIG. 2 can include knitting the exemplary knit element 313 shown in FIG. 8. As shown, knit element 313 is shown in plan view and is generally U-shaped. Knit element 313 can include heel region 103, midfoot region 102, forefoot region 101, lateral side 104, and medial side 105, which correspond to those same regions and sides of footwear 100 shown in FIGS. 1-4 as will become apparent.

Figure 9:
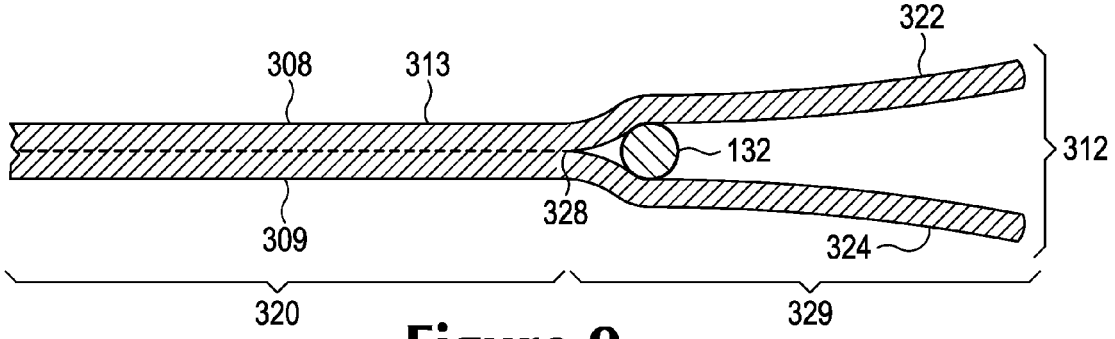
FIG. 9 is a section view of the workpiece taken along the line 9-9 of FIG. 8.

Knit element 313 can include an exterior surface 308 as shown in FIG. 8, and knit element 313 can also include an opposite interior surface 309 as shown in FIG. 9. Moreover, knit element 313 can include a generally U-shaped outer edge 312 and a generally U-shaped inner edge 314. Also, knit element 313 can include a first rear edge 316, which extends between outer edge 312 and inner edge 314. Knit element 313 can similarly include second rear edge 318, which extends between outer edge 312 and inner edge 314. It will be appreciated that the term "inboard direction" as used herein can be considered to be substantially normal to the outer edge 312 and directed inward or inboard generally toward the inner edge 314. The term "outboard direction" can be considered to be substantially normal to the outer edge 312 and directed outward or outboard generally away from the inner edge 314.

Figure 10:
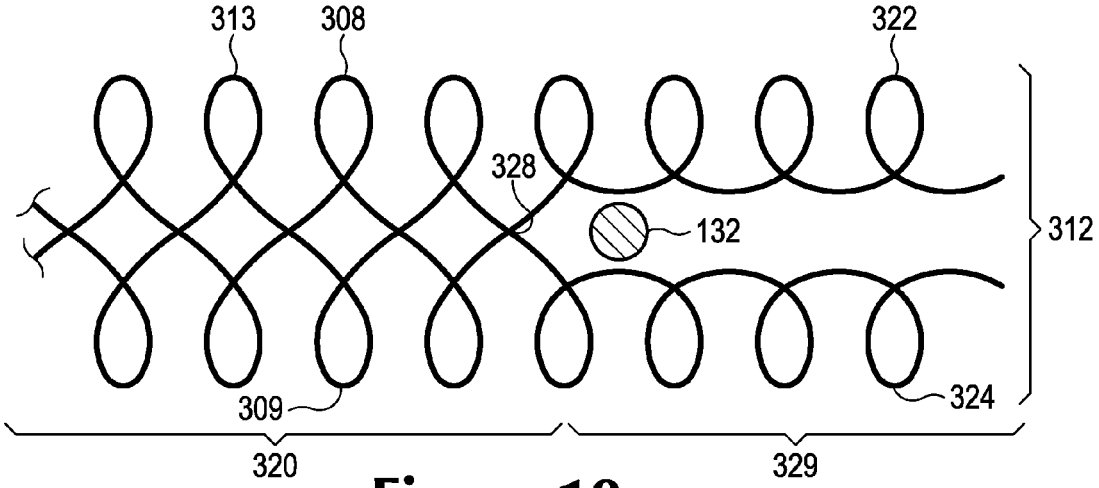
FIG. 10 is a schematic section view of the workpiece of FIG. 8 showing a stitching pattern for the workpiece according to exemplary embodiments of the present disclosure.

As shown in FIG. 9, knit element 313 of knitted workpiece 310 can be formed from a plurality of layers of knitted material. For example, knit element 313 can include a first layer 322 and a second layer 324. In this embodiment, first layer 322 can define exterior surface 308, and second layer 324 can define interior surface 309. First layer 322 and second layer 324 can overlay each other and can each span between outer edge 312, inner edge 314, first rear edge 316, and second rear edge 318. Portions of first layer 322 and second layer 324 can be attached while other portions of first layer 322 and second layer 324 can be detached from each other. In the embodiments of FIG. 9, for example, first layer 322 and second layer 324 are detached along outer edge 312, and first layer 322 and second layer 324 are attached further inboard on the knit element 313. Thus, in some embodiments, a boundary 328 can distinguish between an area where first layer 322 and second layer 324 are attached and another area where first layer 322 and second layer 324 are detached. Also, as shown in FIG. 8, boundary 328 can extend along substantially an entirety of outer edge 312 and can be spaced in an inboard direction from outer edge 312 by a distance 335. FIG. 10 includes a stitching diagram that is suitable for the formation of first layer 322 and second layer 324 of FIG. 9. It will be appreciated, however, that first layer 322 and second layer 324 can be attached in any suitable area of knit element 313 and can be detached from each other in any suitable area of knit element 313.

Accordingly, knit element 313 of knitted workpiece 310 can define a U-shaped central body 320, which is defined between boundary 328, first rear edge 316, inner edge 314, and second rear edge 318. Stated differently, first layer 322 and second layer 324 can be overlaid and attached to each other within central body 320. Knit element 313 can also define a U-shaped outer region 329, which is defined between boundary 328, first rear edge 316, outer edge 312, and second rear edge 318. Thus, first layer 322 and second layer 324 can be overlaid and detached within outer region 329. It will be apparent, thus, that outer region 329 can have a width, which is the previously-described distance 335, between outer edge 312 and boundary 328. In some embodiments, distance 335 can remain substantially constant along the longitudinal length of outer region 329 from heel region 103 to forefoot region 101. In additional embodiments, distance 335 can vary along the longitudinal length of outer region 329.

Figure 11:
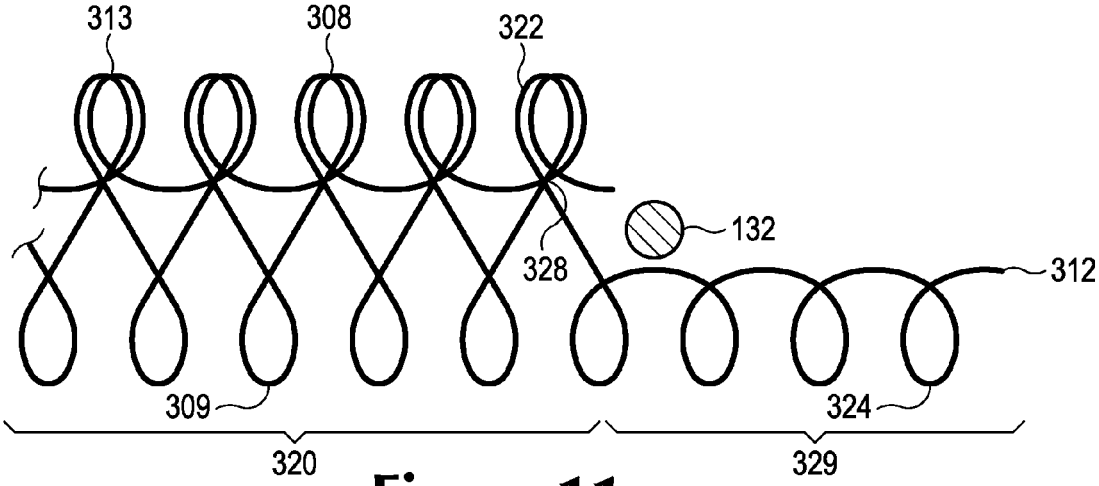
FIG. 11 is a schematic section view of the workpiece showing a stitching pattern according to additional exemplary embodiments of the present disclosure.

An alternative embodiment of outer region 329 is illustrated in FIG. 11. As shown, second layer 324 can be substantially similar to the embodiments of FIG. 10 and can terminate in the outboard direction at outer edge 312. However, first layer 322 can terminate in the outboard direction short of the outer edge 312. Accordingly, while central body 320 is defined by attached first layer 322 and second layer 324, outer region 329 of knit element 313 can be defined solely by second layer 324.

As shown in the embodiment of FIG. 8, knitted workpiece 310 can include one or more tensile strands 132 formed of unitary knit construction with knit element 313. For example, tensile strands 132 can be at least partially inlaid within one or more courses and/or wales of knit element 313. Other areas of tensile strands 132 can extend from knit element 313 and can be exposed from knit element 313.

As shown in the embodiment of FIG. 8, knitted workpiece 310 can include two tensile strands 132, which correspond in location to those shown in the upper 120 of FIGS. 1-4. Thus, separate tensile strands 132 can extend within midfoot region 102 on both lateral side 104 and medial side 105. It will be appreciated, however, that knitted workpiece 310 can include any number of tensile strands 132, and tensile strands 132 can be routed along any suitable area of knit element 313.

For purposes of clarity, one of the tensile strands 132 in the embodiment of FIG. 8 will be discussed. It will be appreciated that both tensile strands 132 can have similar and corresponding features even though tensile strands 132 are routed on opposite sides of workpiece 310. As shown, tensile strand 132 can include a first end 330 and a second end 332. First end 330 and second end 332 can both be disposed within outer region 329 and spaced from each other within midfoot region 102.

Although tensile strand 132 can extend continuously between first end 330 and second end 332, tensile strand 132 can be considered to have a number of sections and turns. For example, a first section 336 can extend from first end 330 in an inboard direction toward a rearmost lace receiving element 126 formed in knit element 313. Tensile strand 132 can also turn about lace receiving element 126 at a first turn 338, and a second section 340 can extend in an outboard direction toward outer region 329. A second turn 342 can extend from second section 340 and can extend along outer region 329. Also, a third section 344 can extend in an inboard direction from second turn 342. Moreover, a third turn 346 can turn about a respective lace receiving element 126, and a fourth section 348 can extend in an outboard direction toward the outer region 329. Next, a fourth turn 350 can extend from fourth section 348 and can extend along outer region 329. Additionally, a fifth section 352 can extend in an inboard direction, and a fifth turn 354 can turn about respective lace receiving element 126. Also, a sixth section 356 can extend in an outboard direction from fifth turn 354 and can terminate at second end 332.

It will be appreciated that first section 336, first turn 338, second section 340, third section 344, third turn 346, fourth section 348, fifth section 352, fifth turn 354, and sixth section 356 can be inlaid within the courses or wales of central body 320 of knit element 313. As such, these portions of tensile strand 132 can be substantially embedded within central body 320. In contrast, first end 330, second turn 342, fourth turn 350, and second end 332 can be disposed within outer region 329, and thus referred to as exposed portions of tensile strand 132. FIGS. 9 and 10 further illustrate in section view that tensile strand 132 is disposed between first layer 322 and second layer 324 within outer region 329 and is relatively exposed. FIG. 11 similarly illustrates that tensile strand 132 can lie upon second layer 324 within outer region 329 and can be exposed as such.

As mentioned above and as will be discussed in detail, the knitted workpiece 310 can be configured to be trimmed to a desired size. Workpiece 310 can be trimmed along any path. For example, as will be discussed in detail, knit element 313 of workpiece 310 can be trimmed along one of a plurality of predetermined trim lines. Two exemplary trim lines are shown in FIG. 8, namely, a first trim line 331 and a second trim line 333. Both first trim line 331 and second trim line 333 are disposed within outer region 329; therefore, outer region 329 can be referred to as a trim region as well for reasons that will become apparent.

First trim line 331 and second trim line 333 are indicated in FIG. 8 with respective broken lines. First trim line 331 and second trim line 333 can be indicated and visually apparent on workpiece 310, or first trim line 331 and second trim line 333 can be a representation not visually indicated on workpiece 310. It will be apparent that there can be any number of trim lines on workpiece 310 and that the trim lines can be routed along any suitable area of workpiece 310.

In the exemplary embodiments of FIG. 8, first trim line 331 is U-shaped and extends continuously along outer edge 312, between first rear edge 316 and second rear edge 318, at a distance 339 from outer edge 312. Distance 339 can remain substantially constant along the longitudinal length of first trim line 331, or distance 339 can vary along the longitudinal length of first trim line 331. Also, second trim line 333 is U-shaped and extends continuously along outer edge 312, between first rear edge 316 and second rear edge 318, at a distance 337 from outer edge 312. In this embodiment, distance 337 can remain substantially constant along the longitudinal length of second trim line 333. In other embodiments, distance 337 can vary along the longitudinal length of second trim line 333 so as to be larger or smaller at various portions of knitted workpiece 310. In some embodiments, distance 339 can be between one to three millimeters in some embodiments. Also, distance 337 can be between two and six millimeters in some embodiments.

Figure 12:
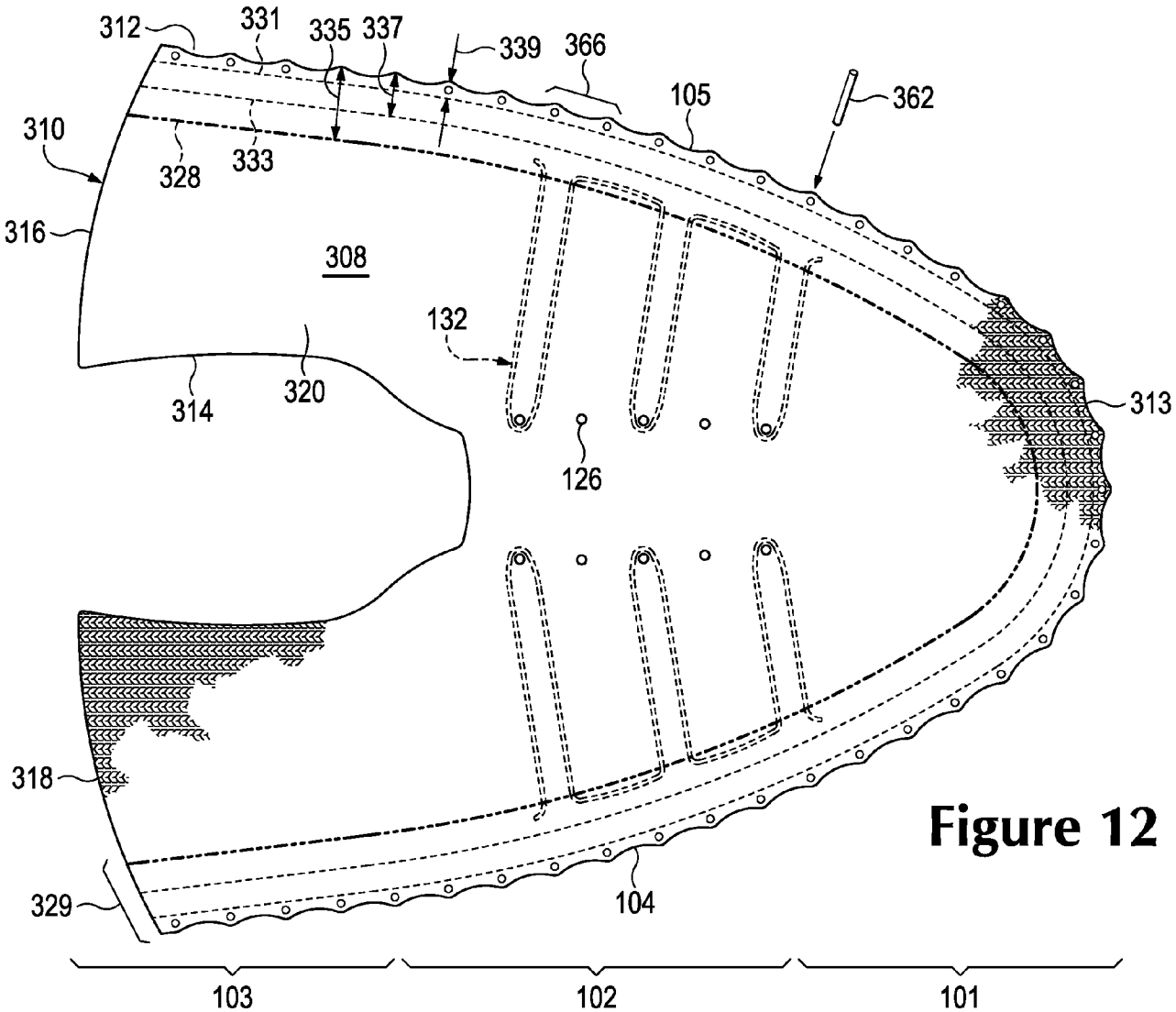
FIG. 12 is a plan view of the workpiece of FIG. 8 shown with fastening elements for securing the workpiece to a support surface.

Referring back to method 1000 shown in FIG. 7A, once knitted workpiece 310 is formed in step 1002, method 1000 can continue in step 1004. In step 1004, knitted workpiece 310 can be secured to a support surface. For example, as shown in FIG. 12, knitted workpiece 310 can be fixed to the support surface using a plurality of fasteners 362. In some embodiments, fasteners 362 can include pins that extend through predetermined portions of knitted workpiece 310 and that penetrate the support surface. An exemplary fastener 362 is shown in perspective view in FIG. 14 being moved toward knitted workpiece 310. In additional embodiments, fasteners 362 can be fixed to the support surface at predetermined locations, and knitted workpiece 310 can be secured to fasteners 362 by sliding predetermined areas of workpiece 310 over fasteners 362.

Figure 14:
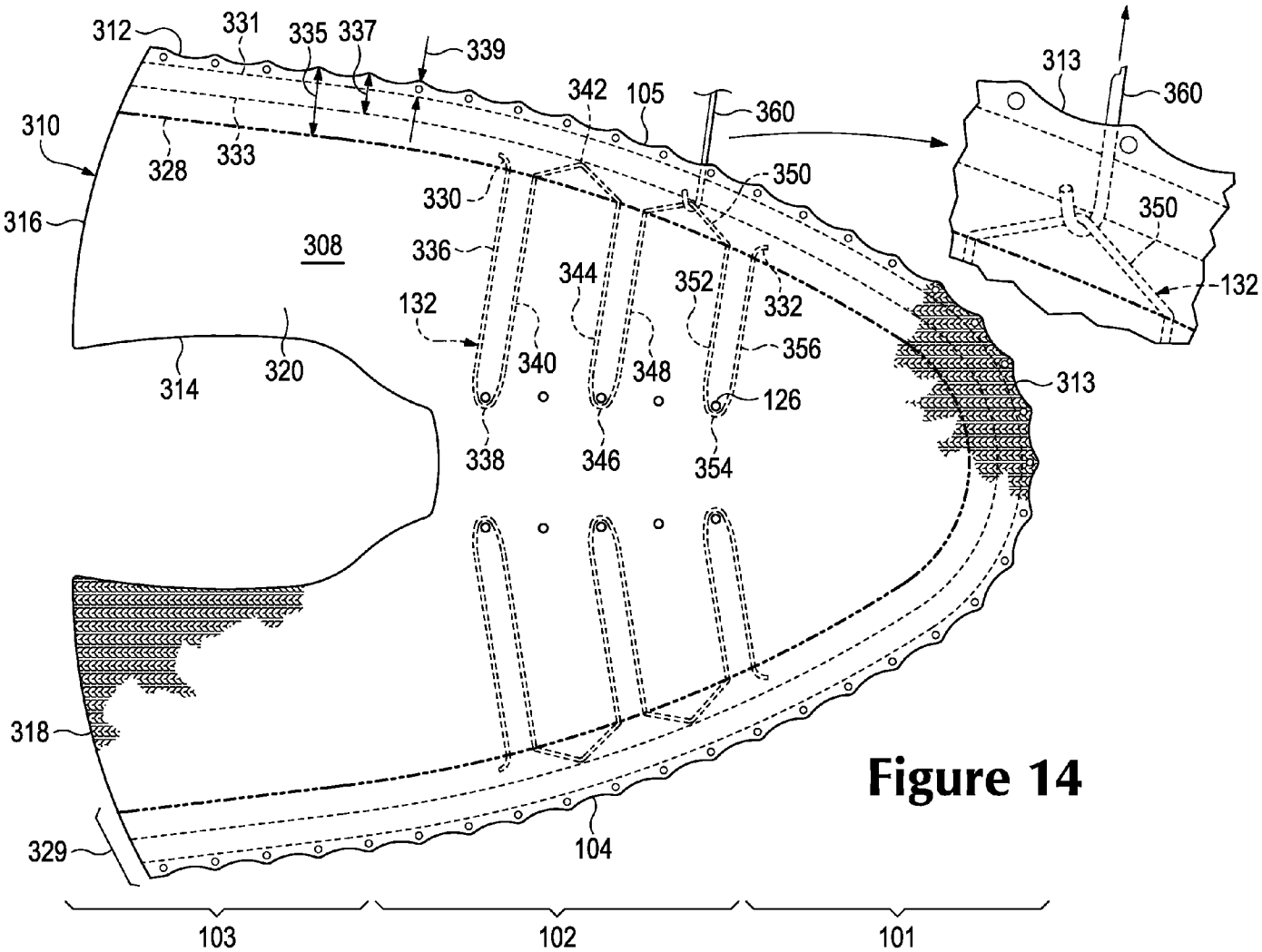
Figure 15:
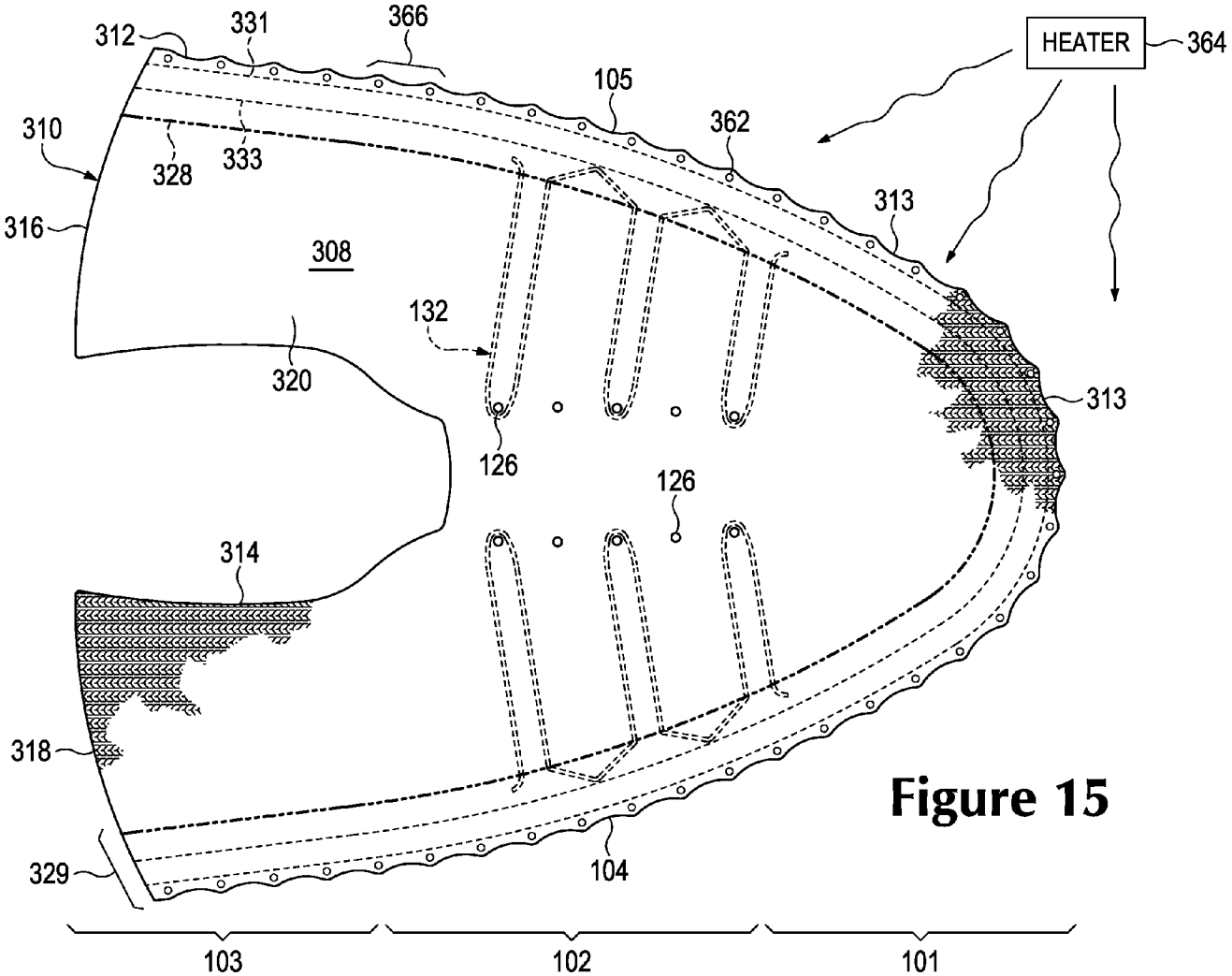
FIG. 15 is a plan view of the workpiece of FIG. 14 shown in the process of being heated.

Fasteners 362 can be used to fix any suitable area of knitted workpiece 310. For example, as shown in FIG. 14, a series of fasteners 362 can be arranged along outer edge 312 and within outer region 329 of knitted workpiece 310. It will be appreciated any number of fasteners 362 can be used, and fasteners 362 can be spaced away from each other by any suitable distance.

Also, outer edge 312 of knitted workpiece 310 can become distorted when secured as shown in FIG. 12. More specifically, knitted workpiece 310 can be stretched between fasteners 362, thereby causing unsecured portions to move inward and forming an uneven outer edge 312. For example, a series of indentations may form along outer edge 312 of knitted workpiece 310 between adjacent pairs of fasteners 362. These indentations can be scallops 366 having a substantially concave shape as shown in FIG. 12, or the indentations may have another shape. Depending on the spacing of fasteners 362, the indentations or scallops 366 may have similar or varying sizes along the outer edge 312 of knitted component 310. Also, as will become apparent, the indentations or scallops 366 can be removed during subsequent trimming of the knitted workpiece 310.

Figure 13:
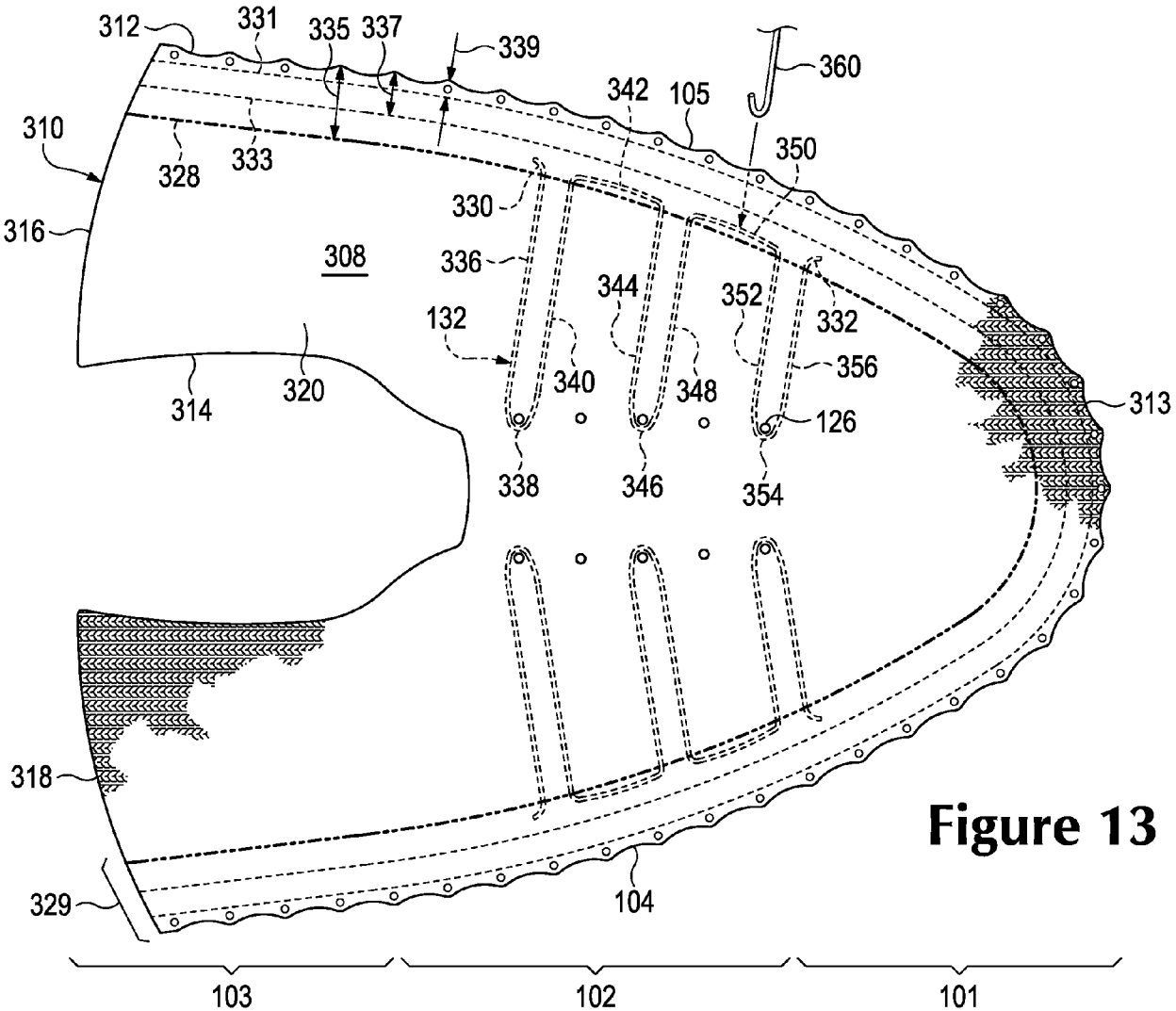
FIGS. 13 and 14 are plan views of the workpiece of FIG. 12 and a tool for adjusting a tensile strand of the workpiece.

As shown in FIG. 7A, method 1000 can continue in step 1006, and tensile strands 132 can be adjusted. For example, tensile strands 132 may need to be tensioned in order to remove slack within tensile strands 132. Also, tensile strands 132 can be pulled to shift strands 132 relative to knit element 313. Stated differently, tensile strand 132 can be moved and adjusted relative to knit element 313 to position tensile strand 132 in a desired position and configuration. FIGS. 13 and 14 illustrate exemplary embodiments of step 1006.

In some embodiments, tensile strand 132 can be adjusted by hand. As shown in other embodiments represented in FIG. 13, an adjustment tool 360 can be used for adjusting tensile strand 132. For example, adjustment tool 360 can be a hook or other tool suitable for grasping tensile strand 132.

As shown in FIGS. 13 and 14, adjustment tool 360 can be inserted between first layer 322 and second layer 324 of outer region 329 to grasp onto and manipulate the tensile strand 132. In the illustrated embodiments, adjustment tool 360 is shown grasping fourth turn 350, but it will be appreciated that first end 330, second turn 342, or second end 332 are exposed and can be similarly grasped by tool 360.

Then, as shown in FIG. 14, tool 360 can be pulled away from knitted workpiece 310. As a result, tensile strand 132 can be pulled in the outboard direction and/or can be otherwise shifted relative to knit element 313. Stated differently, portions of tensile strand 132 embedded within central body 320 of knit element 313 can be pulled and moved to a desired position relative to lace receiving elements 126 and/or other portions of knit element 313. For example, in the embodiments of FIG. 13, by pulling and otherwise manipulating fourth turn 350, slack within the inlaid fourth section 348 and fifth section 352 can be reduced. Other portions of tensile strand 132 can be similarly adjusted and moved relative to knit element 313. Once tensile strand 132 is adjusted, friction from knit element 313 can hold tensile strand 132 relative to knit element 313. Also, in some embodiments, pins or other fasteners can be used to temporarily hold tensile strands 132 in this adjusted position.

As shown in the illustrated embodiments of FIG. 13, tensile strand 132 can be disposed inboard of both first trim line 331 and second trim line 333, even after tensile strand 132 has been adjusted with tool 360. Stated differently, in the plan view of FIG. 13, tensile strand 132 can be encircled collectively by first rear edge 316, inner edge 314, second rear edge 318, and second trim line 333. Thus, tensile strand 132 can be spaced away in an inboard direction from first trim line 331 and second trim line 333. Accordingly, when workpiece 310 is trimmed along first trim line 331 or second trim line 333, the tensile strand 132 is unlikely to be cut.

Subsequently, as shown in FIG. 7A, method 1000 can continue in step 1008. In step 1008, knitted workpiece 310 can be heated. A heat source 364 can be used for these purposes as shown schematically in FIG. 15. In some embodiments, heat source 364 can supply steam to knitted workpiece 310. In other embodiments, heat source 364 can be configured to supply substantially dry heat to workpiece 310. In still additional embodiments, heat source 364 can first supply steam to knitted workpiece 310, and heat source 364 can subsequently apply additional heat for drying knitted workpiece 310.

Heat can be applied for various reasons. In some embodiments, the heat can cause knitted workpiece 310 to shrink in size in a predetermined manner. The heat can also reduce bunching in knitted workpiece 310, can reduce slack within stitching in knit element 313, and/or flatten out knitted workpiece 310. Also, as stated above, knit element 313 can include fusible yarns in some embodiments. Therefore, heat from heat source 364 can cause the fusible yarns to partially melt and, upon cooling, the fusible yarns can be attached or bonded to surrounding elements or components. For example, the fusible yarns can attach or bond to other surrounding fusible yarns. The fusible yarns can also attach or bond to respective portions of tensile strands 132 such that tensile strands 132 can be fixed relative to knit element 313.

Figure 16:
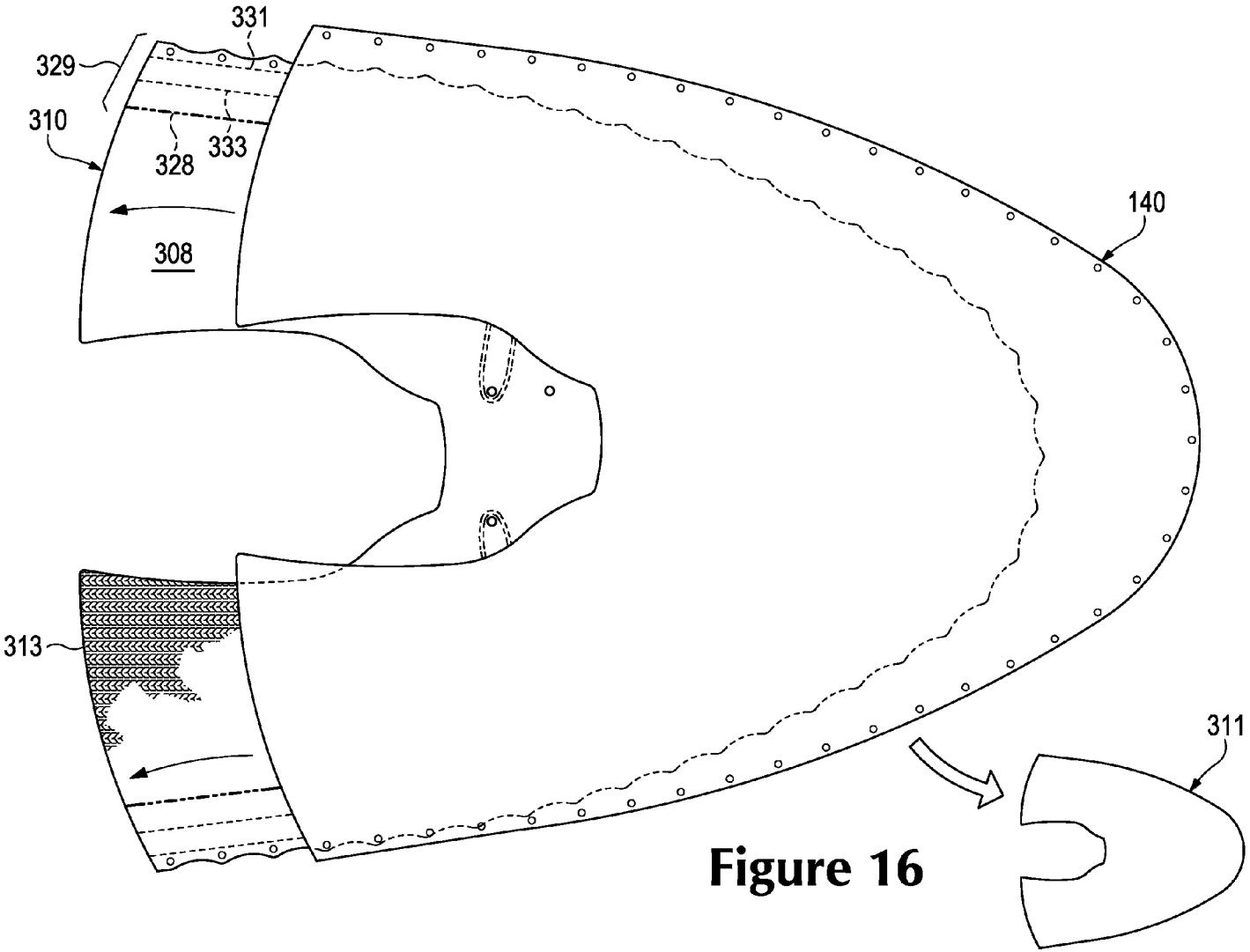
FIG. 16 is a schematic plan view of the workpiece of FIG. 15 and a skin layer in the process of being attached to the workpiece.

Next, method 1000 can continue in step 1012 as shown in FIG. 7A and as described below. Alternatively, as shown in FIG. 7B, method 1000 can continue in step 1010. Step 1010 can include adding skin layer 140 to knitted workpiece 310. This is illustrated in FIG. 16. As shown, skin layer 140 can be layered over and attached to exterior surface 308 of knitted workpiece 310. Although skin layer 140 is shown as covering substantially the entire knitted workpiece 310 in FIG. 16, it will be appreciated that skin layer 140 can only partially cover knitted workpiece 310 in other embodiments. Also, in some embodiments, skin layer 140 can cover one or more indentations along outer edge 313 including one or more scallops 366. Skin layer 140 can also cover first trim line 331 and/or second trim line 333. Once skin layer 140 is attached, knitted workpiece 310 can be converted to a "skinned workpiece 311" as shown in FIG. 16.

As mentioned above, and as shown in FIG. 6, knitted workpiece 310 and/or skinned workpiece 311 can be used to construct uppers of two different sizes. It will be appreciated that a larger shoe size will typically require a larger upper than that of a smaller shoe size. Thus, one or more edges of the knitted workpiece 310 and/or skinned workpiece 311 can be trimmed to a predetermined dimension that corresponds to the desired shoe size. For example, in the illustrated embodiments, outer edge 312 can be trimmed. However, it will be appreciated that the other edges or other areas of workpiece 310, 311 can be trimmed in some embodiments to provide workpiece 310, 311 with the desired dimensions.

Figure 17:
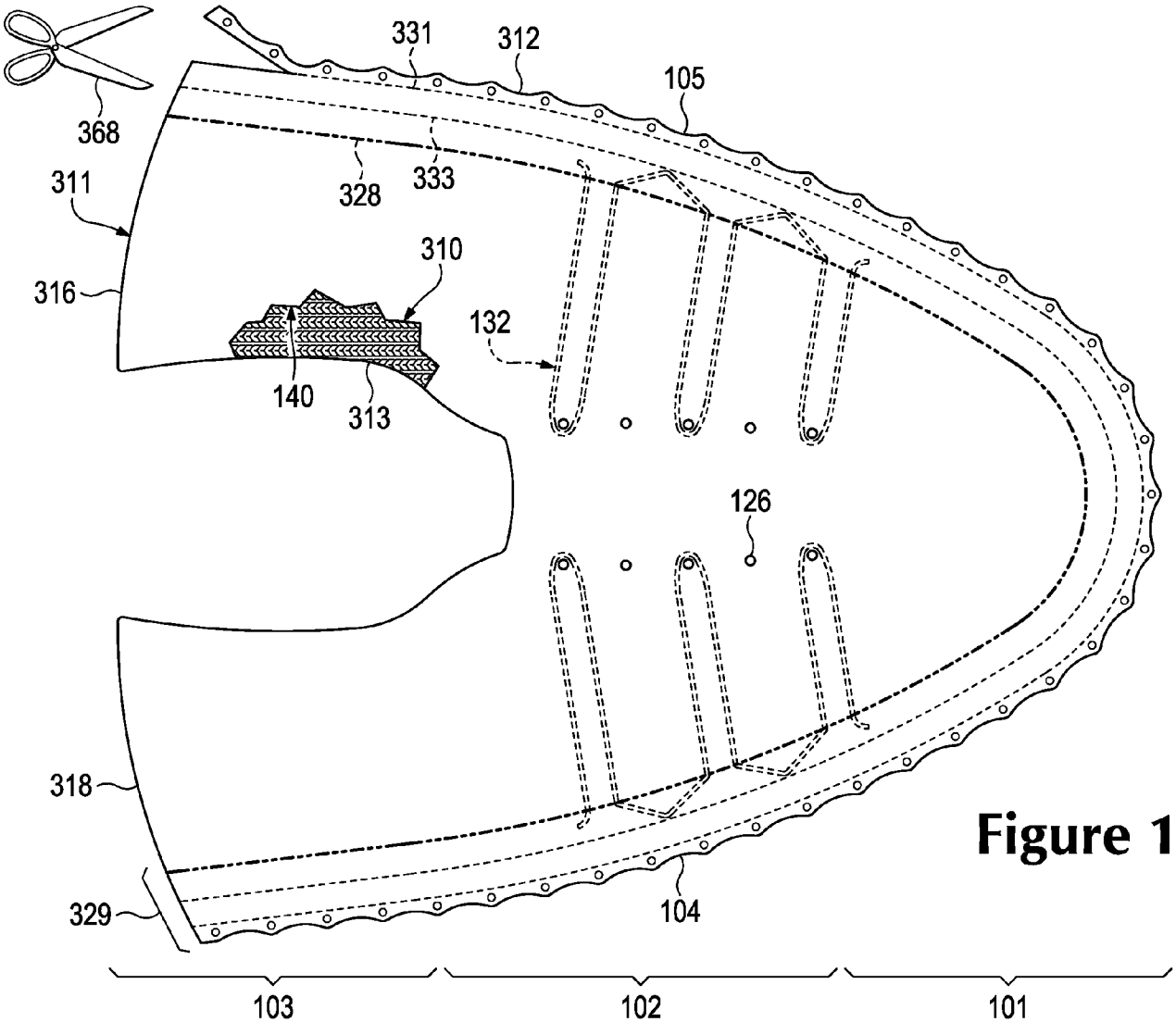
FIGS. 17 and 18 are schematic plan views of the workpiece of FIG. 16 being trimmed along a first trim line to form the upper for the article of footwear of a first foot size.
Figure 18:
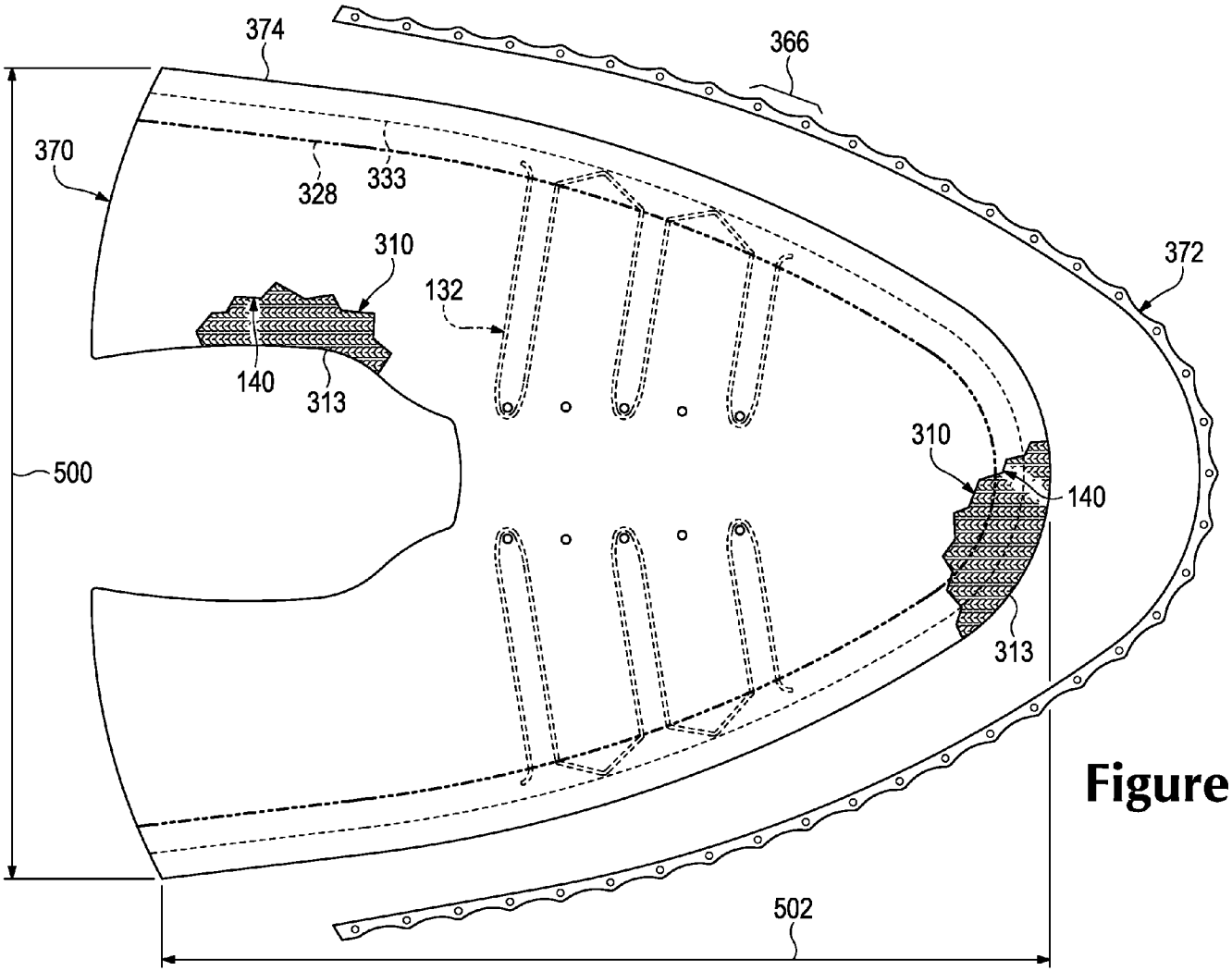

Thus, as shown in FIG. 7B, method 1000 can continue in decision step 1012. If decision step 1012 is answered affirmatively and the upper for the larger foot size 402 is to be formed, then step 1014 can follow. Step 1014 is illustrated in FIGS. 17 and 18 according to exemplary embodiments. However, if decision step 1012 is answered negatively, and the upper for the smaller foot size 401 is to be formed, then step 1016 can follow. Step 1016 is illustrated in FIGS. 19 and 20 according to exemplary embodiments.

Assuming that the larger upper for the larger foot size 402 is to be formed, skinned workpiece 311 can be trimmed using a trimming tool 368 along first trim line 331. Trimming tool 368 can be a pair of shears as shown. In additional embodiments, trimming tool 368 can be a cutting die or other suitable cutting tool. Once fully trimmed, skinned workpiece 311 can be divided into a first trimmed piece 370 and a first removed piece 372. As shown in the illustrated embodiments, first removed piece 372 can include each of the scallops 366. Thus, scallops 366 can be removed from first trimmed piece 370. Also, as a result of this trimming, first trimmed piece 370 can have a new, trimmed edge 374. This trimmed edge 374 can at least partially define one or more predetermined dimensions of the upper 120 for use in the larger shoe size 402 of FIG. 6. Specifically, trimmed edge 374 can define a predetermined first width 500 and/or first length 502 of trimmed piece 370 as shown in FIG. 18. First width 500 and second width 502 dimensions can be suitable for forming the upper 120 for the size 9 shoe shown in the embodiments of FIG. 6.

Figure 19:
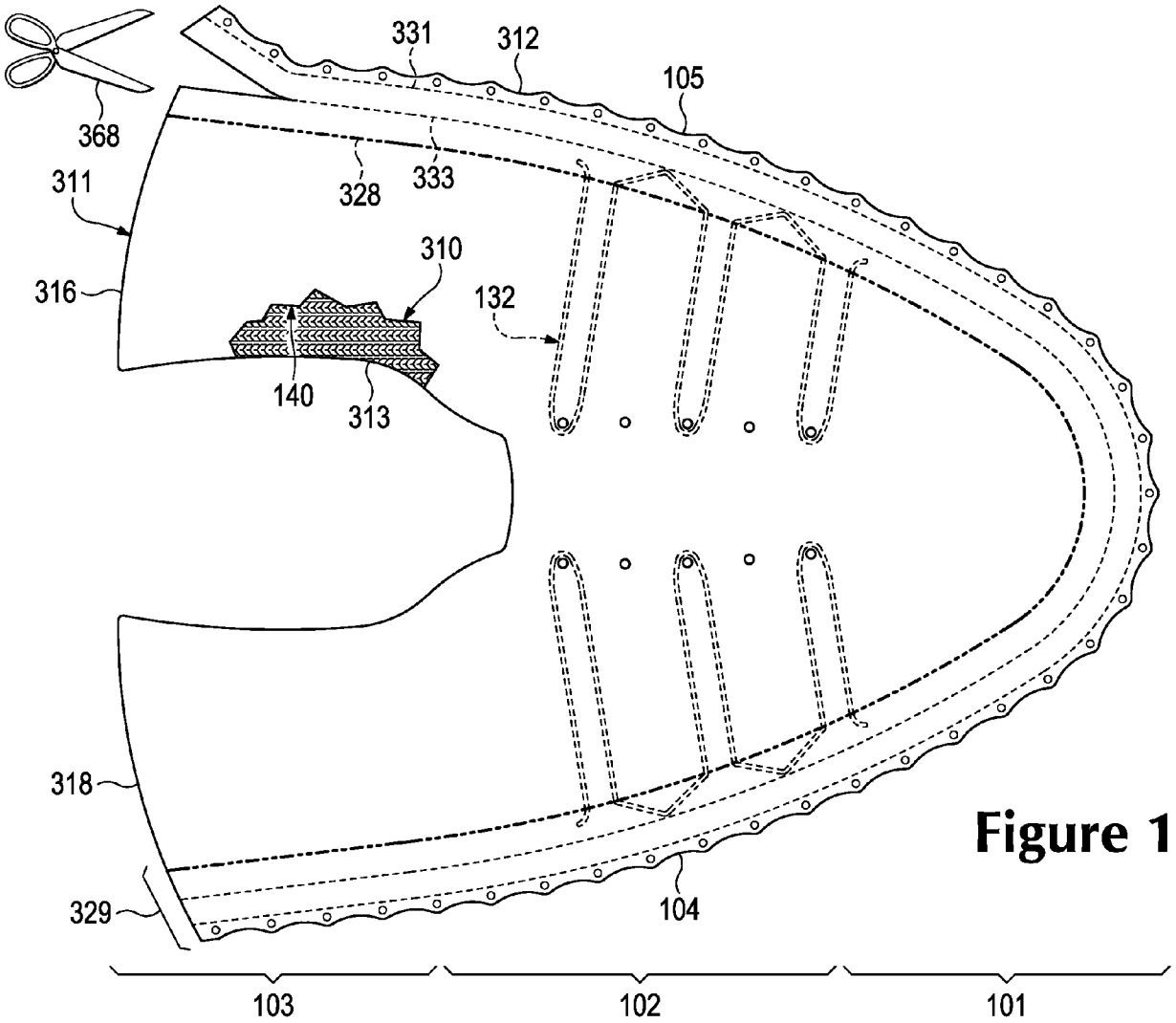
FIGS. 19 and 20 are schematic plan views of the workpiece of FIG. 16 being trimmed along a second trim line to form the upper for the article of footwear of a second foot size.

In contrast, if step 1012 of FIG. 7B is answered negatively and the upper is to be formed for the smaller shoe size 401 of FIG. 6, then skinned workpiece 311 can be trimmed along second trim line 333 as illustrated in FIG. 19. As a result, skinned workpiece 311 can be divided into a second trimmed piece 376 and a second removed piece 378 as shown in FIG. 20. Thus, scallops 366 can be removed, and second trimmed piece 376 can have a new, trimmed edge 380. Also, trimmed edge 380 can define a predetermined second width 504 and length 506 for second trimmed piece 376. Second width 504 and second length 506 can be less than first width 500 and second length 502, respectively, of FIG. 18. Second width 504 and second length 506 can also correspond to dimensions of upper 120 for the size 8.5 shoe shown in the embodiments of FIG. 6.

Figure 20:
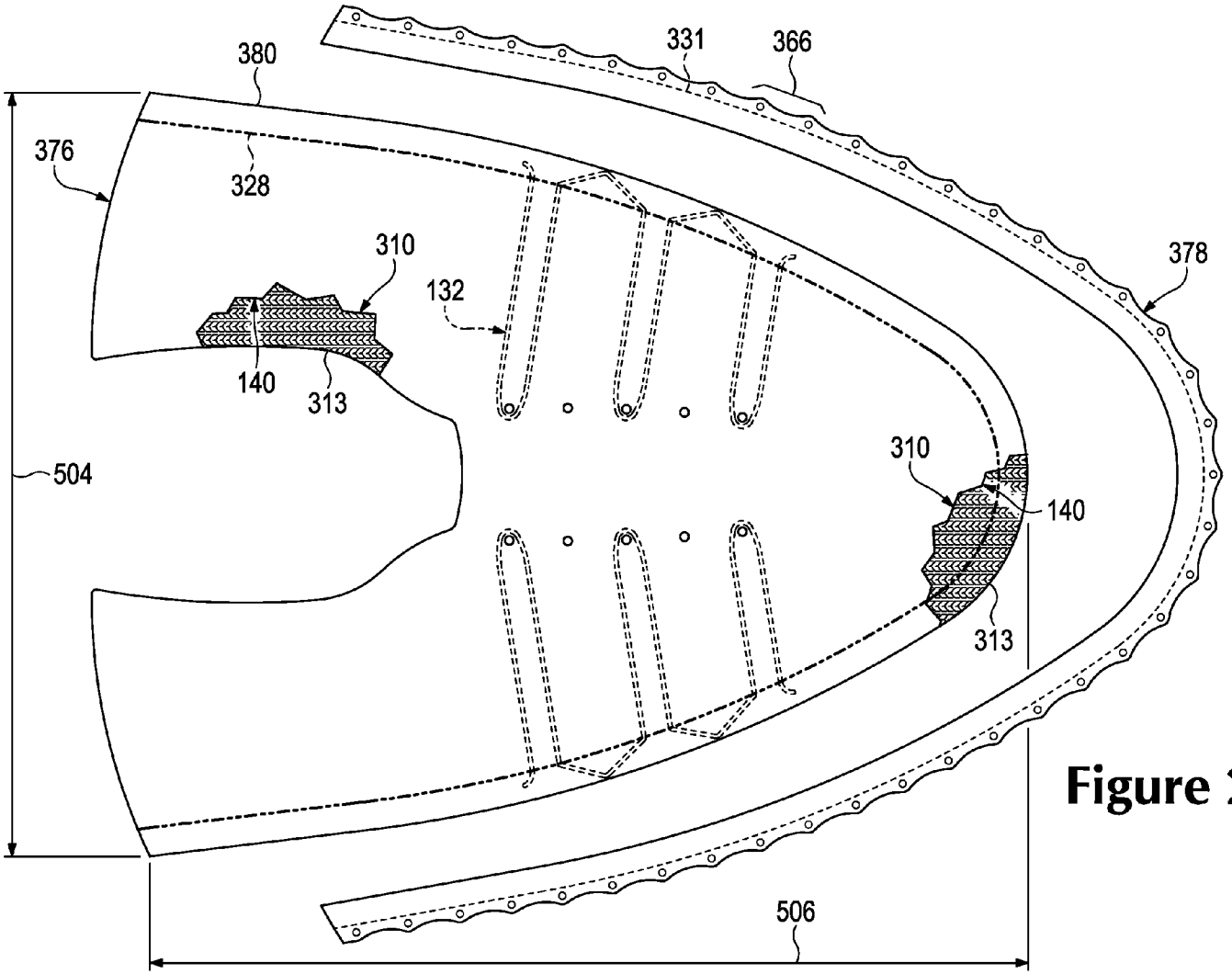

Additionally, it will be appreciated that trimmed edge 374 of FIG. 18 and trimmed edge 380 of FIG. 20 can be bonded and secured such that trimmed edge 374 and trimmed edge 380 are unlikely to inadvertently unravel or fray. For example, the fusible yarns within knit element 313 can fuse and secure trimmed edge 374 and trimmed edge 380 to prevent unraveling in some embodiments. Also, in some embodiments, skin layer 140 can bond and secure trimmed edge 374 and trimmed edge 380 to prevent unraveling.

Referring back to FIG. 7B, method 1000 can continue in step 1018. In step 1018, strobel 128 can be attached as shown in FIG. 5. Specifically, strobel 128 can be attached to first trimmed edge 374 or second trimmed edge 380, whatever the case may be. Moreover, strobel 128 can be attached via stitching, adhesives, or other fastening devices. Additionally, in some embodiments, portions of tensile strands 132 may be left extending freely and/or exposed relative to edge 374, 380. In these embodiments, these portions of tensile strand 132 can be secured to strobel 128, for example, via the same stitching, adhesives, or other fastening devices. It will be appreciated that, in some embodiments, upper 120 for the respective article of footwear 100 can be complete after step 1018. In additional embodiments, tags, logos, or other objects can be added to upper 120 after step 1018.

Finally, as shown in FIG. 7B, method 1000 can conclude in step 1020. In step 1020, sole structure 110 can be attached to upper 120. As shown in FIG. 4, edge 374, 380 can be disposed over, embedded, or otherwise attached to sole structure 110. Likewise, any exposed or free ends of tensile strands 132 and respective areas of skin layer 140 can be disposed within, embedded, and fixed to sole structure 110 in step 1020.

As stated above, method 1000 can vary from the embodiment illustrated in FIG. 7B without departing from the scope of the present disclosure. For example, steps shown in FIG. 7B can be omitted, added, combined with other steps, substituted with alternate steps, or otherwise varied. For example, an alternate embodiment of method 1000 is illustrated in FIG. 7A. As shown, method 1000 can be substantially similar to that shown in FIG. 7B; however, step 1010 has been omitted. Thus, optional skin layer 140 is not added to knitted workpiece 310 in this embodiment of method 1000. Instead, knitted workpiece 310 is heated in step 1008, and then knitted workpiece 310 is trimmed in step 1014 or step 1016 as discussed above with reference to FIGS. 17-20.

Accordingly, method 1000 and the articles constructed using method 1000 can increase manufacturing efficiency. For example, fewer tools, devices, parts, and other implements may be needed since the same tools, devices, parts, and implements can be used to form uppers 120 of different sizes. Also, bottlenecks in forming footwear 100 caused by the knitting process can be reduced since the same knitted workpiece 310 can be used to form two different-sized uppers 120. Additionally, by removing the indentations, scallops 366 or other irregularities causing an uneven edge from knitted workpiece 310 and/or skinned workpiece 311, attaching strobel 128 can be facilitated since the mating edges are more likely to butt up directly together.

While various embodiments of the present disclosure have been described, the description is intended to be exemplary rather than limiting, and it will be apparent to those of ordinary skill in the art that many more embodiments and implementations are possible that are within the scope of the present disclosure. Accordingly, the present disclosure is not to be restricted except in light of the attached claims and their equivalents. Also, various modifications, combinations, and changes of the features described herein may be made within the scope of the attached claims.

What is claimed is:

1. A method of forming an article of footwear comprising:

knitting a knitted workpiece formed of unitary knit construction, the knitted workpiece configured to at least partially form an upper of the article of footwear, the knitted workpiece having a body and a trim region, the trim region defining at least a portion of an outer edge of the knitted workpiece, a first dimension of the knitted workpiece defined at least partly by the outer edge;

heating the knitted workpiece;

trimming the knitted workpiece within the trim region after heating the knitted workpiece to remove a piece from the knitted workpiece and to reduce the first dimension to a second dimension; and forming the upper from the trimmed knitted workpiece.

2. The method of claim 1, further comprising attaching a skin layer to the knitted workpiece.

3. The method of claim 2, wherein attaching the skin layer occurs after heating the knitted workpiece and before trimming the knitted workpiece.

4. The method of claim 1, wherein knitting the knitted workpiece includes knitting the knitted workpiece with at least one fusible strand.

5. The method of claim 1, wherein knitting the knitted workpiece includes knitting the knitted workpiece to include a knit element and a tensile strand, the tensile strand including at least one inlaid portion that is inlaid within the knit element, the tensile strand also including an exposed portion that is exposed from the knit element, wherein the exposed portion is spaced from the outer edge in an inboard direction on the knitted workpiece, and further comprising pulling on the exposed portion to move and adjust the at least one inlaid portion relative to the knit element.

6. The method of claim 5, wherein the at least one inlaid portion includes a first inlaid portion and a second inlaid portion, and wherein the exposed portion extends continuously between the first inlaid portion and the second inlaid portion.

7. The method of claim 5, wherein knitting the knitted workpiece includes forming the outer edge with a first layer and a second layer formed of unitary knit construction, the first layer and the second layer overlaying each other and connected in the body, the first layer and the second layer overlaying each other and disconnected in the trim region, and wherein knitting the knitted workpiece includes disposing the exposed portion of the tensile strand between the first layer and the second layer in the trim region.

8. The method of claim 5, wherein knitting the knitted workpiece includes knitting the knitted workpiece with a first layer and a second layer formed of unitary knit construction, the first layer and the second layer overlaying each other and connected in the body, the first layer extending further in an outboard direction on the knitted component than the second layer to define the trim region and the outer edge, and wherein knitting the knitted workpiece includes disposing the exposed portion of the tensile strand on the first layer within the trim region.

9. The method of claim 1, further comprising fixing a first area of the knitted workpiece to a support surface and fixing a second area of the knitted workpiece to the support surface before heating the knitted workpiece, the first area and the second area being spaced from each other along the outer edge, wherein an indentation is formed in the outer edge between the first area and the second area, and wherein trimming the knitted workpiece includes removing the indentation from the knitted workpiece.

10. The method of claim 1, further comprising selecting whether to form the article of footwear to fit a first foot size or a second foot size, wherein trimming the knitted workpiece includes trimming the knitted workpiece along a first trim line when selecting to form the article of footwear to fit the first foot size, and wherein trimming the knitted workpiece includes trimming the knitted workpiece along a second trim line when selecting to form the article of footwear to fit the second foot size, the second trim line being spaced from the first trim line in an inboard direction on the knitted workpiece.

11. A method of forming an article of footwear that is configured to fit one of a first foot size and a second foot size, the first foot size being larger than the second foot size, the method comprising:

selecting whether to form the article of footwear to fit the first foot size or the second foot size;

providing a knitted workpiece formed of unitary knit construction, the knitted workpiece including a body and a trim region, wherein providing the knitted workpiece includes knitting to form the knitted workpiece having a knit element and a tensile strand, the tensile strand including at least one inlaid portion that is inlaid within the knit element, the tensile strand also including an exposed portion that is exposed from the knit element, wherein the exposed portion is spaced from an outer edge of the knitted workpiece in an inboard direction on the knitted workpiece, and further comprising pulling on the exposed portion to move and adjust the inlaid portion relative to the knit element; and trimming the knitted workpiece within the trim region to form a first trimmed piece;

wherein trimming the knitted workpiece includes forming a first trimmed piece upon selecting to form the article of footwear to fit the first foot size, wherein trimming the knitted workpiece includes forming a second trimmed piece upon selecting to form the article of footwear to fit the second foot size, and wherein the first trimmed piece is configured to form a first upper that fits the first foot size, and the second trimmed piece is configured to form a second upper that fits the second foot size.

12. The method of claim 11, further comprising heating the knitted workpiece.

13. The method of claim 11, further comprising attaching a skin layer to the knitted workpiece.

14. The method of claim 11, wherein providing the knitted workpiece includes knitting the knitted workpiece.

15. The method of claim 14, wherein knitting the knitted workpiece includes knitting at least one fusible strand to at least partially form the knitted workpiece.

16. The method of claim 11, wherein providing the knitted workpiece includes flat knitting the knitted workpiece such that the knitted workpiece is a flat knitted workpiece.

17. The method of claim 11, wherein the at least one inlaid portion includes a first inlaid portion and a second inlaid portion, and wherein the exposed portion extends continuously between the first inlaid portion and the second inlaid portion.

18. The method of claim 11, wherein providing the knitted workpiece includes knitting the knitted workpiece to include a first layer and a second layer formed of unitary knit construction, the first layer and the second layer overlaying each other and connected in the body, the first layer and the second layer overlaying each other and disconnected in the trim region, and wherein knitting the knitted workpiece includes disposing the exposed portion of the tensile strand between the first layer and the second layer in the trim region.

19. The method of claim 11, wherein providing the knitted workpiece includes knitting the knitted workpiece to include a first layer and a second layer formed of the unitary knit construction, the first layer and the second layer overlaying each other and connected in the body, the first layer extending further in an outboard direction on the knitted component than the second layer to define the trim region and the outer edge, and wherein knitting the knitted workpiece includes disposing the exposed portion of the tensile strand on the first layer within the trim region.

* * * * *